US011377264B2

(12) United States Patent
Tan

(10) Patent No.: US 11,377,264 B2
(45) Date of Patent: Jul. 5, 2022

(54) TAMPER EVIDENT SEALABLE BAG ASSEMBLY WITH NOTE TAB AND METHOD

(71) Applicant: Pan Pacific Plastics Mfg., Inc., Hayward, CA (US)

(72) Inventor: Hin Siang Michael Tan, Danville, CA (US)

(73) Assignee: Pan Pacific Plastics Manufacturing, Inc., Hayward, CA (US)

( * ) Notice: Subject to any disclaimer, the term of this patent is extended or adjusted under 35 U.S.C. 154(b) by 0 days.

(21) Appl. No.: 17/137,045

(22) Filed: Dec. 29, 2020

(65) Prior Publication Data

US 2021/0114775 A1 Apr. 22, 2021

Related U.S. Application Data

(63) Continuation-in-part of application No. 16/400,231, filed on May 1, 2019, and a continuation of
(Continued)

(51) Int. Cl.
*B65D 33/16* (2006.01)
*B65D 30/20* (2006.01)
(Continued)

(52) U.S. Cl.
CPC ..... *B65D 33/1691* (2013.01); *B65D 31/10* (2013.01); *B65D 33/004* (2013.01);
(Continued)

(58) Field of Classification Search
CPC .. B65D 33/1691; B65D 31/10; B65D 33/004; B65D 33/06; B65D 33/34; B65D 2401/00; B65D 2203/00; B65D 2401/05
(Continued)

(56) References Cited

U.S. PATENT DOCUMENTS 2,128,196 A 8/1938 Vogel
3,811,613 A 5/1974 Harrison
(Continued)

FOREIGN PATENT DOCUMENTS

CN 2347943 11/1999
DE 29500157 2/1995
(Continued)

OTHER PUBLICATIONS

Machine translation of DE-29500157-U 1.
(Continued)

*Primary Examiner* — Jes F Pascua
(74) *Attorney, Agent, or Firm* — Beyer Law Group LLP

(57) ABSTRACT

A tamper evident delivery bag assembly includes a single use closure tape is laterally mounted to the first panel upper section, and includes an upper lateral portion extending laterally above the first edge of the bag assembly in an unsealed condition. The tape upper lateral portion can be folded over the second edge of the second panel such that an adhesive of the tape is brought into contact with the exterior surface of the second panel, substantially sealing the bag opening in a sealed condition. The leg portions of the handles are received through the cutouts of the tape. The closure tape member further includes a note tab extending downwardly from a middle lateral portion thereof. The note tab includes a tab adhesive and a removable protective cover. When the protective cover is removed, the note can be placed between the tab adhesive and the exterior surface of the first panel, and adhered therebetween in a mounted condition.

22 Claims, 24 Drawing Sheets

Related U.S. Application Data application No. 29/757,049, filed on Nov. 2, 2020, which is a continuation-in-part of application No. 29/751,573, filed on Sep. 22, 2020, which is a continuation of application No. 29/748,869, filed on Sep. 1, 2020.

(60) Provisional application No. 62/672,981, filed on May 17, 2018, provisional application No. 63/090,391, filed on Oct. 12, 2020.

(51) Int. Cl.
*B65D 33/06* (2006.01)
*B65D 33/00* (2006.01)

(52) U.S. Cl.
CPC ..... *B65D 33/06* (2013.01); *B65D 2203/00* (2013.01); *B65D 2401/05* (2020.05)

(58) Field of Classification Search
USPC ..... 383/5, 30, 31, 74, 78
See application file for complete search history.

(56) References Cited

U.S. PATENT DOCUMENTS

| | | | | |
|---|---|---|---|---|
| 5,352,041 | A * | 10/1994 | Fullerton | B65D 33/34 383/38 |
| 5,608,949 | A | 3/1997 | Cooley et al. | |
| D501,134 | S | 1/2005 | Takahashi | |
| D512,490 | S | 12/2005 | Brancato | |
| 9,630,748 | B2 | 4/2017 | Keller | |
| D811,896 | S | 3/2018 | Wigman | |
| D821,223 | S | 6/2018 | Tan | |
| D828,763 | S | 9/2018 | Tan | |
| D830,849 | S | 10/2018 | Tan | |
| D864,752 | S | 10/2019 | Tan | |
| 10,913,578 | B2 * | 2/2021 | Tan | B65D 33/246 |
| 2006/0072855 | A1 * | 4/2006 | Shaw | B65D 33/1691 383/5 |
| 2007/0292053 | A1 | 12/2007 | Lin | |
| 2017/0166358 | A1 * | 6/2017 | Chandaria | B65D 33/06 |
| 2019/0112116 | A1 | 4/2019 | Su et al. | |

FOREIGN PATENT DOCUMENTS

| | | | | |
|---|---|---|---|---|
| DE | 102009007985 | | 2/2010 | |
| EP | 0515086 | | 11/1992 | |
| EP | 3623316 | A1 * | 3/2020 | B65D 77/24 |
| GB | 2382562 | A * | 6/2003 | B65D 33/1691 |
| JP | 01254557 | | 10/1989 | |
| JP | H02213001 | U * | 1/1990 | |
| JP | 02-031846 | | 7/1990 | |
| JP | 05-042035 | Y | 10/1993 | |
| JP | 2017061324 | | 3/2017 | |
| JP | 2017186073 | A * | 10/2017 | |
| KR | 10-1935325 | | 12/2018 | |

OTHER PUBLICATIONS

Machine translation of JP-01254557.
International Search Report and Witten Opinion from International Application No. PCT/US2019/030891, dated Jul. 26, 2019.
International Search Report from International Application No. PCT/US2021/054409 dated Jan. 26, 2022.
Written Opinion from International Application No. PCT/US2021/054409 dated Jan. 26, 2022.
Final Office Action from U.S. Appl. No. 17/124,244 dated Feb. 4, 2022.

* cited by examiner

TAMPER EVIDENT SEALABLE BAG ASSEMBLY WITH NOTE TAB AND METHOD

RELATED APPLICATIONS

This application is a continuation-in-part application based upon patent application Ser. No. 16/400,231, filed May 1, 2019, which is entitled "TAMPER EVIDENT TAPE AND SEALED BAG ASSEMBLY FOR HANDLED BAGS AND METHOD", naming Tan as the inventor, which in turn claims priority under 35 U.S.C. § 119(e) from U.S. Provisional Patent Application No. 62/672,981, filed May 17, 2018, which is entitled "TAMPER EVIDENT TAPE ASSEMBLY TO SEAL HANDLED BAGS", naming Tan as the inventor, and which are all incorporated by reference in their entirety. This application also claims priority under 35 U.S.C. § 119(e) from U.S. Provisional Patent Application No. 63/090,391, filed Oct. 12, 2020, entitled "TAMPER EVIDENT TAPE AND SEALED BAG ASSEMBLY FOR HANDLED BAGS AND METHOD", naming Tan as inventor, and which is incorporated by reference in its entirety. Finally, this application is a continuation application to U.S. Design patent application No. 29/757,049, filed Nov. 2, 2020, entitled "SEALABLE TAPE WITH NOTE TAB FOR A BAG ASSEMBLY", naming Tan as the inventor, which in turn is a continuation-in-part application based upon U.S. Design patent application No. 29/751,573, filed Sep. 22, 2020, entitled "SEALABLE BAG WITH NOTE TAB", naming Tan as the inventor, which in turn is a continuation application to U.S. Design patent application No. 29/748,869, filed Sep. 1, 2020, entitled "SEALABLE BAG WITH NOTE TAB", naming Tan as the inventor, and which are all incorporated by reference in their entirety.

FIELD OF THE INVENTION

The present invention relates to handled bags, and more particularly, relates to single use, food service, sealable bags with integrated venting.

BACKGROUND OF THE INVENTION

Conventional lunch bag-shaped paper bags have been in use in the food industry since at least the commencement of take-out fast food services. These upper open ended paper bags are easy to open, fill and close, providing simple access to its contents.

More recently, handled paper and plastic bags are becoming more commonly used in food delivery. While the use of these handled paper and plastic bags continues to proliferate in the food service industry, especially with the recent growth of third party food delivery services, the potential for food tampering also increases. Both the food preparer/provider and the consumer would like assurance the food prepared has not in any manner been touched or tampered prior to the delivery, as well as assure the consumer that they received the proper delivery without having to immediately open the sealed delivery bag.

Accordingly, it is desirable to provide a single use, handled paper or plastic delivery bag that is capable of being sealed in a manner that enables the end consumer assurance that the handled bag has not been opened, and that the prepared food therein has not been tampered with. It is also desirable to provide a sealed bag assembly that enables a note, such as a purchase receipt, order ticket, pick ticket, etc., to be easily attached to the sealed bag assembly for simple viewing of the order information such as the order number, consumer identification, order contents, purchase price, date and time, etc.

SUMMARY OF THE INVENTION

The present invention provides a tamper evident delivery bag assembly comprising a sheet-like first panel, an opposed sheet-like second panel, and a bottom gusset. Each the first and second panel includes an interior surface that faces the opposing panel and an exterior surface, and each panel further includes a respective upper section terminating at an upper first edge of the first panel and an opposed upper second edge of the second panel. The first and second edges cooperate to at least partially define a bag opening into a content receiving region extending between the bag opening, the panels and the bottom gusset. The upper sections are movable between an opened condition and a closed condition, the closed condition where the first and second edges generally oriented in opposed, adjacent, relationship to one another.

The present inventive delivery bag assembly further includes a single use closure tape member laterally mounted to the first panel upper section, and includes an upper lateral portion extending laterally above the first edge thereof in an unsealed condition. An adhesive is disposed on an interior surface of the tape upper lateral portion facing the second panels when in the unsealed condition. A removable protective strip is provided that covers the adhesive to maintain the tape in the unsealed condition until sealing is required. Hence, when the protective strip is removed, and the panel upper sections are aligned in the closed condition, the tape upper lateral portion can be folded over the second edge of the second panel such that the adhesive is brought into contact with the exterior surface of the second panel, substantially sealing the bag opening in a sealed condition.

In accordance with the present invention, the closure tape member further includes a note tab extending downwardly from the middle lateral portion. The note tab includes a tab adhesive disposed on an interior surface thereof facing the exterior surface of the first panel. A removable protective cover is disposed over the tab adhesive, in an unmounted condition, preventing unintentional adherence of the note tab to the exterior surface of the first panel. When the protective cover is removed, a note can be placed between the tab adhesive of the note tab and the exterior surface of the first panel, and adhered therebetween in a mounted condition.

Accordingly, by additionally adhering the note to the sealed bag assembly, bag contents and delivery destination can be easily identified, especially if the bag assembly has already been sealed.

In one specific embodiment, the lateral dimension of the note tab is in the range of about ¼ to about ⅓ the lateral length of the middle lateral portion of the closure tape member.

In another configuration, the note tab is positioned along one of the left side, the middle and the right side of the middle lateral portion of the closure tape member.

In another embodiment, a vertical dimension of the note tab extending downwardly from a lower edge of the middle lateral portion is in the range of about ¼ inch to about 1½ inch.

In still another specific embodiment, the note tab includes a tab cutout configured to facilitate the ease of removal of the protective cover. The tab cutout, in one example, is positioned at a lower corner of the note tab.

Yet another configuration provides the delivery bag assembly with a first handle mounted to the upper section of the first panel having a pair spaced-apart first leg portions upstanding from the first edge. Further, a second handle is mounted to the upper section of the second panel having a pair spaced-apart second leg portions upstanding from the second edge The first and second handles together with the first and second leg portions are generally aligned adjacent one another and collectively define a gripping passage therethrough when the upper sections are oriented in the closed condition. The tape upper lateral portion includes a pair of handle cutouts strategically aligned with the leg portions of the first handle such that when the tape upper lateral portion is folded over the second edge of the second panel in the sealed condition, the leg portions of the first and second handles are received through the respective handle cutouts of the tape member.

In one specific embodiment, the tape upper lateral portion defines a middle closure section having a closure height extending vertically from the first edge to an upper edge of the middle closure section. The closure height is less than a vertical height of the gripping passage such that when the tape upper lateral portion is folded over the second edge of the second panel to the sealed condition, the middle closure section passes unobstructedly under the aligned handle members and through the gripping passage.

Another configuration provides the tape upper lateral portion that defines a first outer closure section and a second outer closure section on opposed sides of the middle closure section. At least one of the first outer closure section and the second outer closure section defines a closure cutout configured to facilitate the ease of removal of the protective strip.

In one embodiment, the bag assembly is comprised of one of paper material and plastic material.

In still another specific configuration, the tape member includes a plurality of elongated scoring slits extending in a direction substantially transverse to the respective first and second edge of the respective first and second panel and across the bag opening when the upper sections are in the closed condition and the tape member is in the sealed.

In another aspect of the present invention, a tamper evident method for delivering one or more food containers in a bag assembly that is configured to mount a note thereon. The method includes providing a handled delivery bag assembly having a sheet-like first panel, and an opposed sheet-like second panel, each the first and second panel having an interior surface that faces the opposing panel and an exterior surface Further, each panel further includes a respective upper section terminating at an upper first edge of the first panel and an opposed upper second edge of the second panel. The first and second edges cooperate to at least partially define a bag opening into a content receiving region extending between the bag opening and the first and second panels. The upper sections are movable between an opened condition and a closed condition. The bag assembly further includes a single use closure tape member laterally mounted to the first panel upper section at a middle lateral portion thereof, and having an upper lateral portion extending laterally above the first edge thereof in an unsealed condition. The closure tape member further including a note tab extending downwardly from the middle lateral portion in an unmounted condition. The method further includes reorienting the upper sections of the bag assembly to the opened condition to enable receipt of the one or more food containers in the content receiving region, and repositioning the upper sections of the bag assembly from the opened condition to the closed condition, orienting the first and second edges generally in opposed, adjacent, relationship to one another. The method includes exposing a closure adhesive disposed on an interior surface of the tape upper lateral portion facing the second panel when in the unsealed condition, and subsequently, folding the tape upper lateral portion over the second edge of the second panel such that the adhesive is brought into contact with the exterior surface of the second panel, substantially sealing the bag opening in a sealed condition. In accordance with the present invention, the method further includes exposing a tab adhesive disposed on an interior surface of the note tab facing the exterior surface of the first panel. Next, the method includes placing the note between the exposed tab adhesive of the note tab and the exterior surface of the first panel; and adhering the note therebetween in a mounted condition.

In one specific embodiment, the exposing the closure adhesive includes removing a protective strip from the closure adhesive; and the exposing the tab adhesive includes removing a protective cover from the tab adhesive.

Another embodiment includes the bag assembly having a first handle mounted to the upper section of the first panel having a pair spaced-apart first leg portions upstanding from the first edge, and a second handle mounted to the upper section second panel having a pair spaced-apart second leg portions upstanding from the second edge. The first and second handles together with the first and second leg portions are generally aligned adjacent one another and collectively defining a gripping passage therethrough when the upper sections are oriented in the closed condition. The tape upper lateral portion define a pair of handle cutouts strategically aligned with the leg portions of the first handle, wherein, the folding the tape upper lateral portion includes receiving the leg portions of the first and second handles through the respective handle cutouts of the tape member.

In yet another embodiment, the tape upper portion defining a middle closure section having a closure height extending vertically from the first edge to an upper edge of the middle closure section, the closure height being less than a vertical height of the gripping passage. The folding the tape upper lateral portion includes passing the middle closure section unobstructedly under the aligned handle members and through the gripping passage toward the sealed condition.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawings, in which:

DETAILED DESCRIPTION OF THE INVENTION

Figure 1:
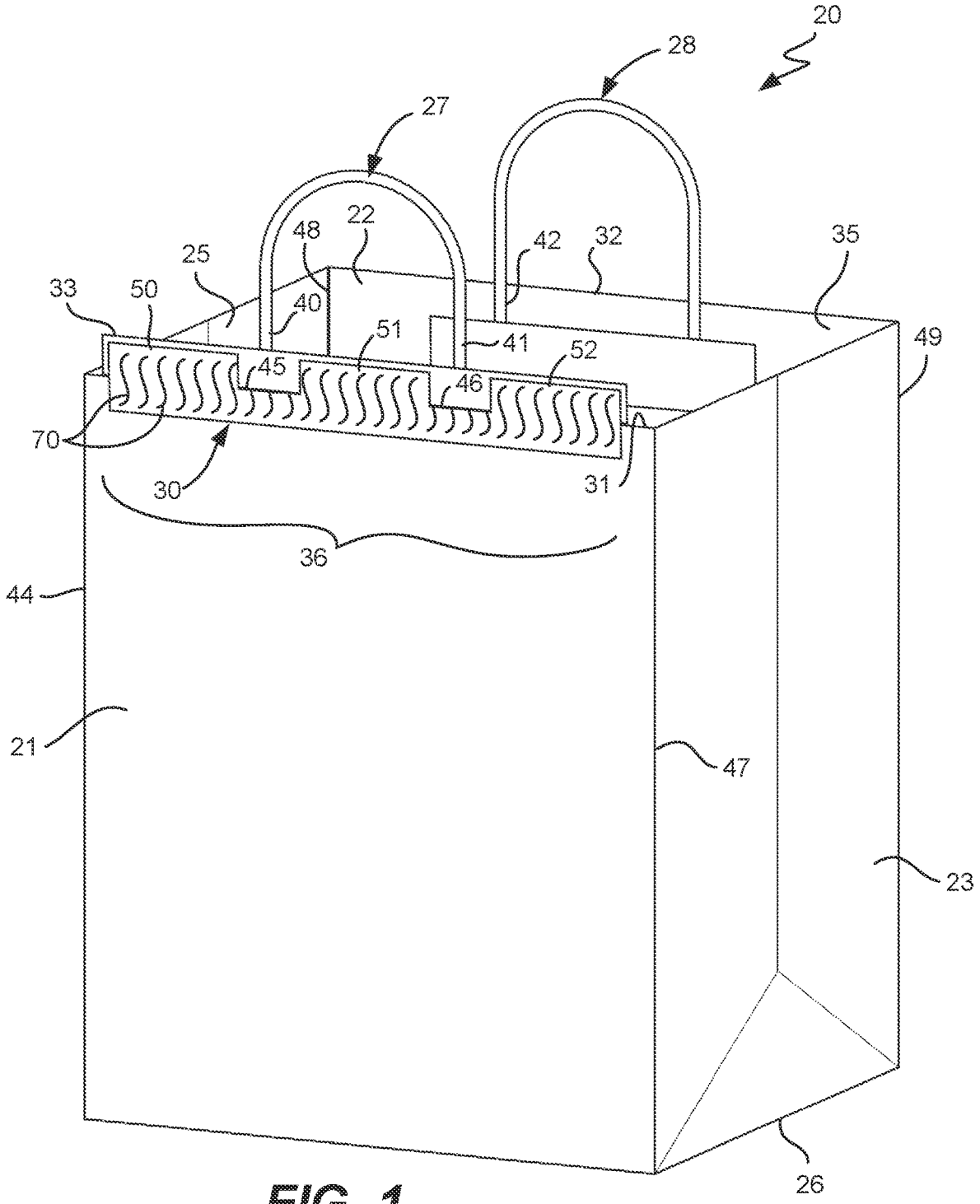
FIG. 1 is a front perspective view of a sealable, handled bag assembly constructed in accordance with the present invention with an upper section thereof in an opened condition.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 6:
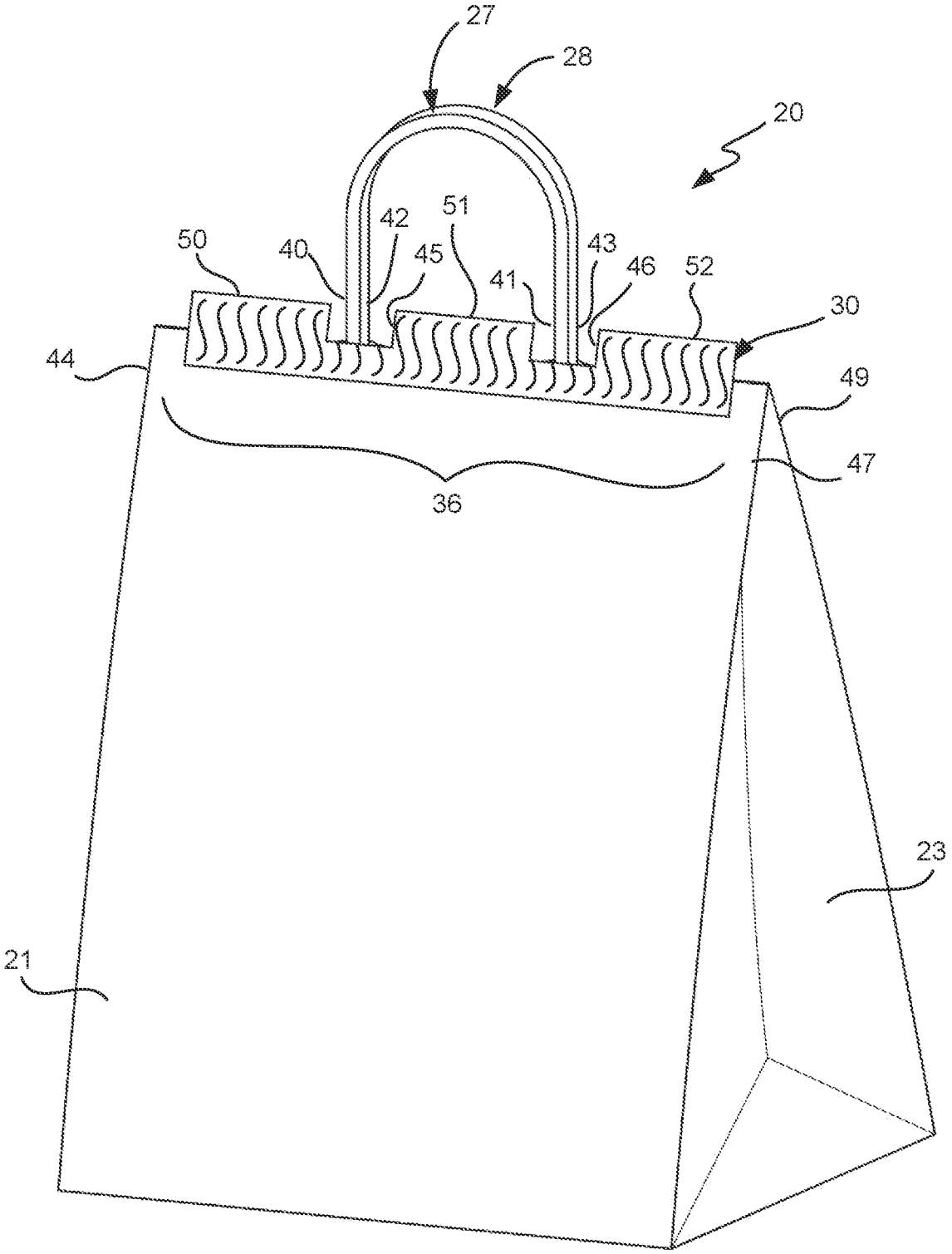
FIG. 6 is a front perspective view of the bag assembly of FIG. 5, illustrating an upper section thereof in a closed condition.
Figure 7:
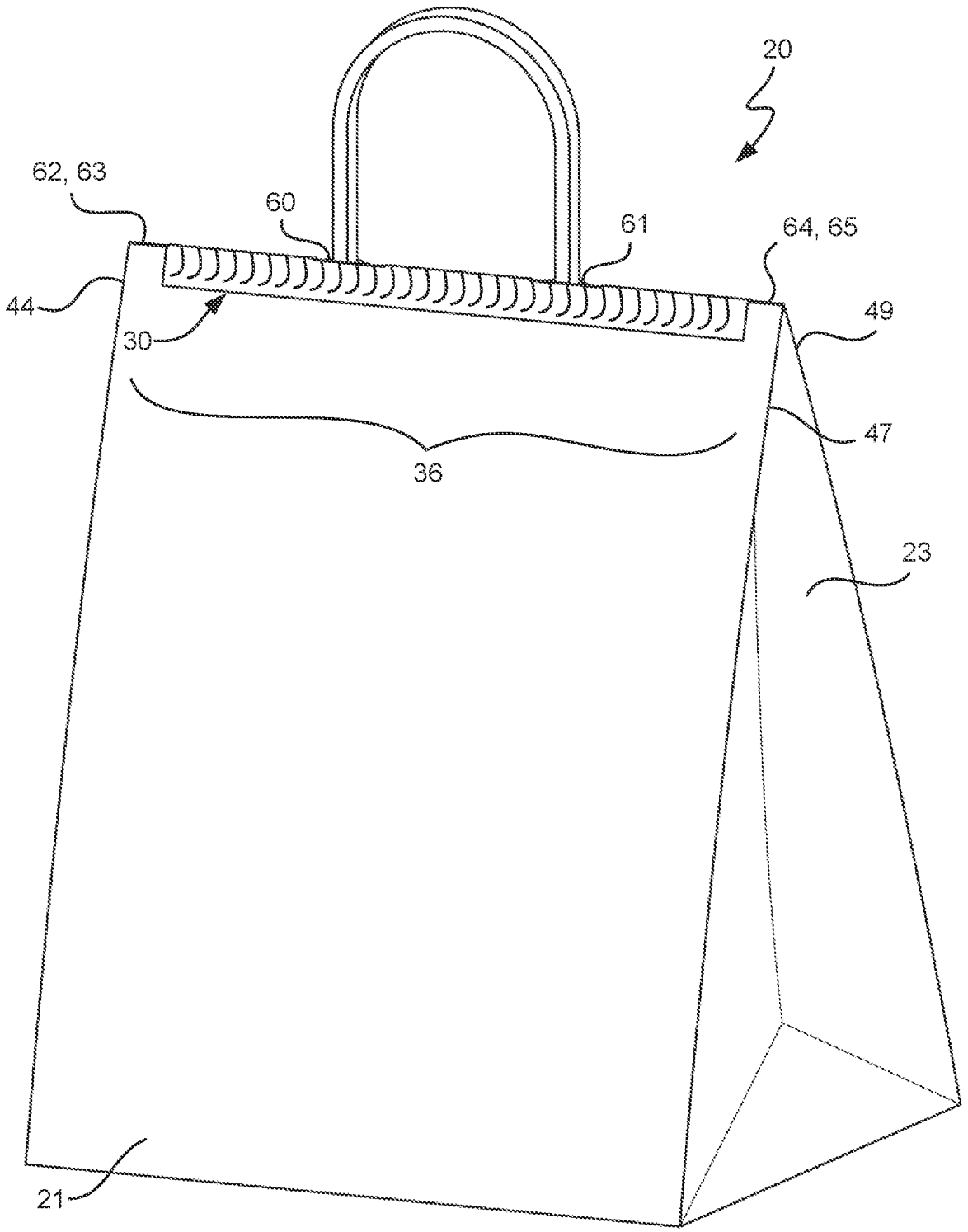
FIG. 7 is a front perspective view of the bag assembly of FIG. 6, illustrating the tape member in a sealed condition.
Figure 8:
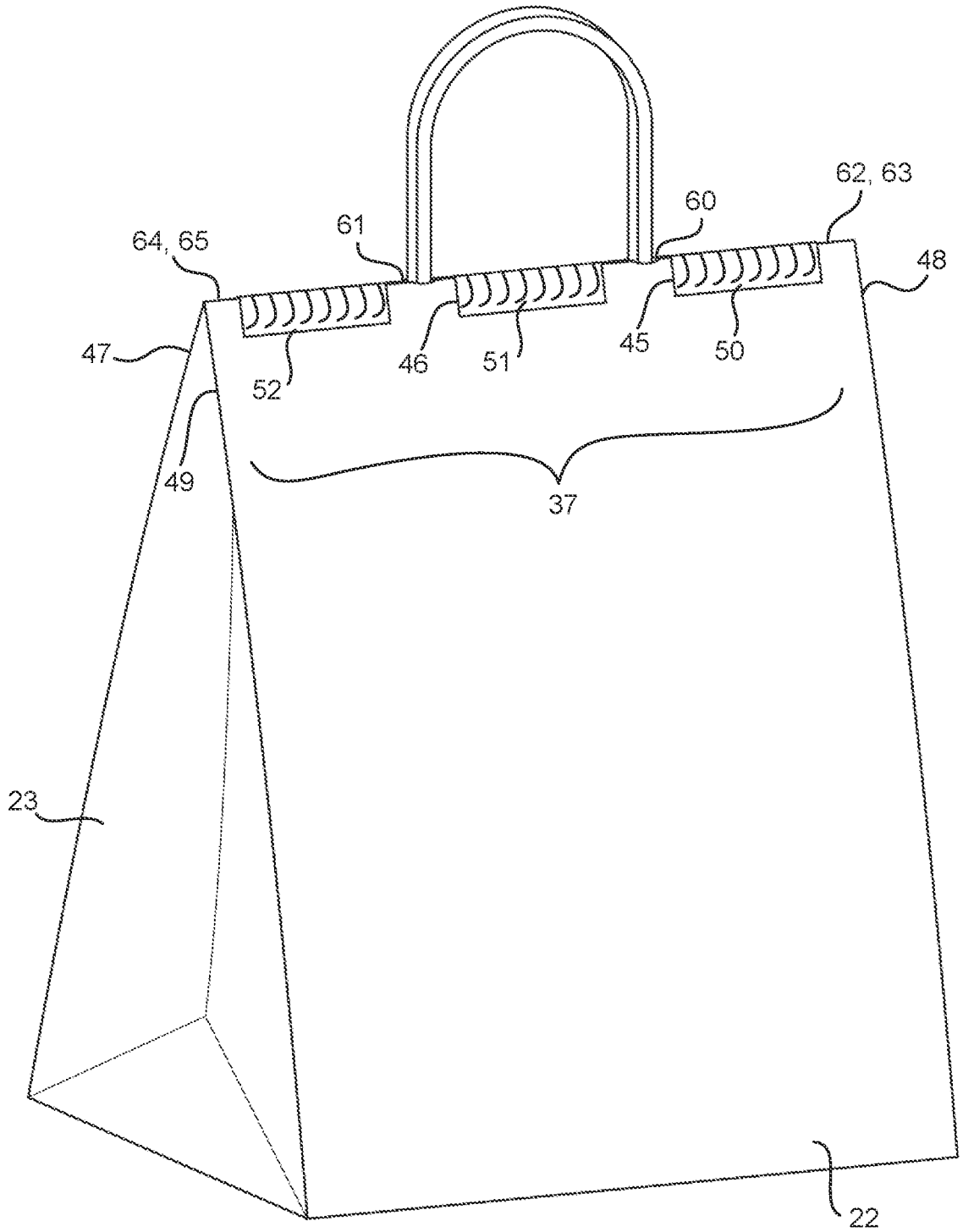
FIG. 8 is a rear perspective view thereof.
Figure 9:
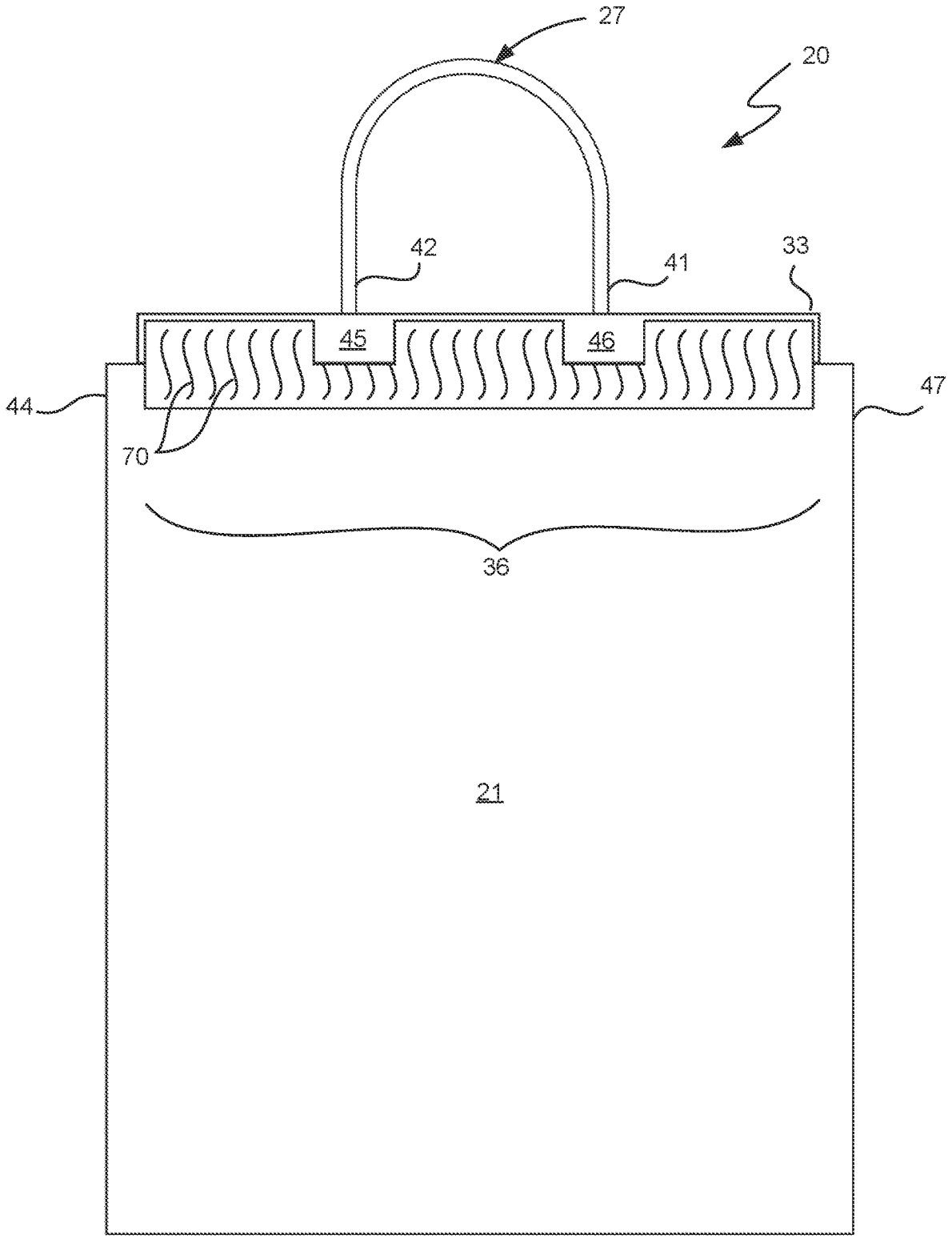
FIG. 9 is a front elevation view of the bag assembly of FIG. 1.
Figure 10:
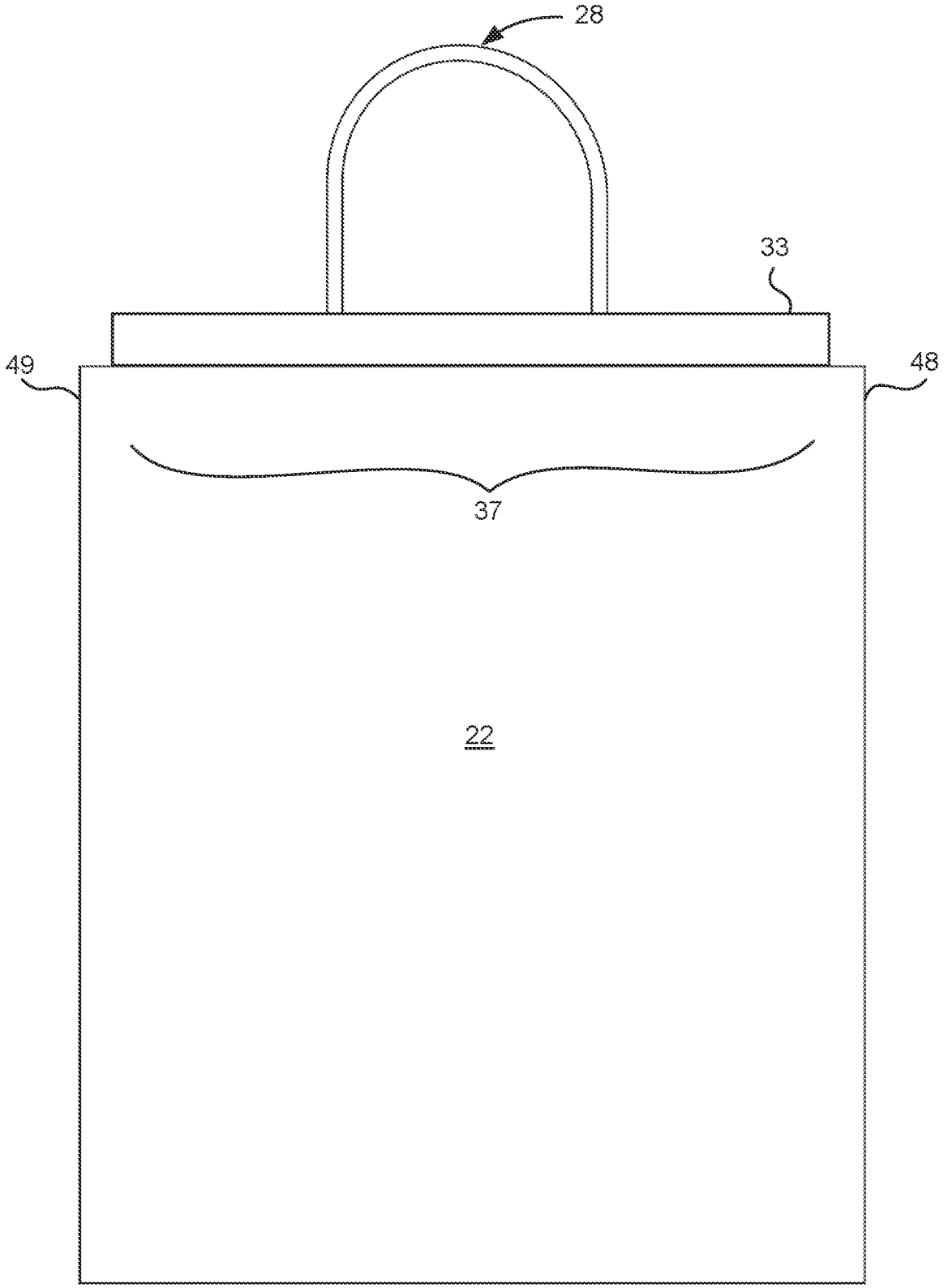
FIG. 10 is a rear elevation view thereof.
Figure 11:
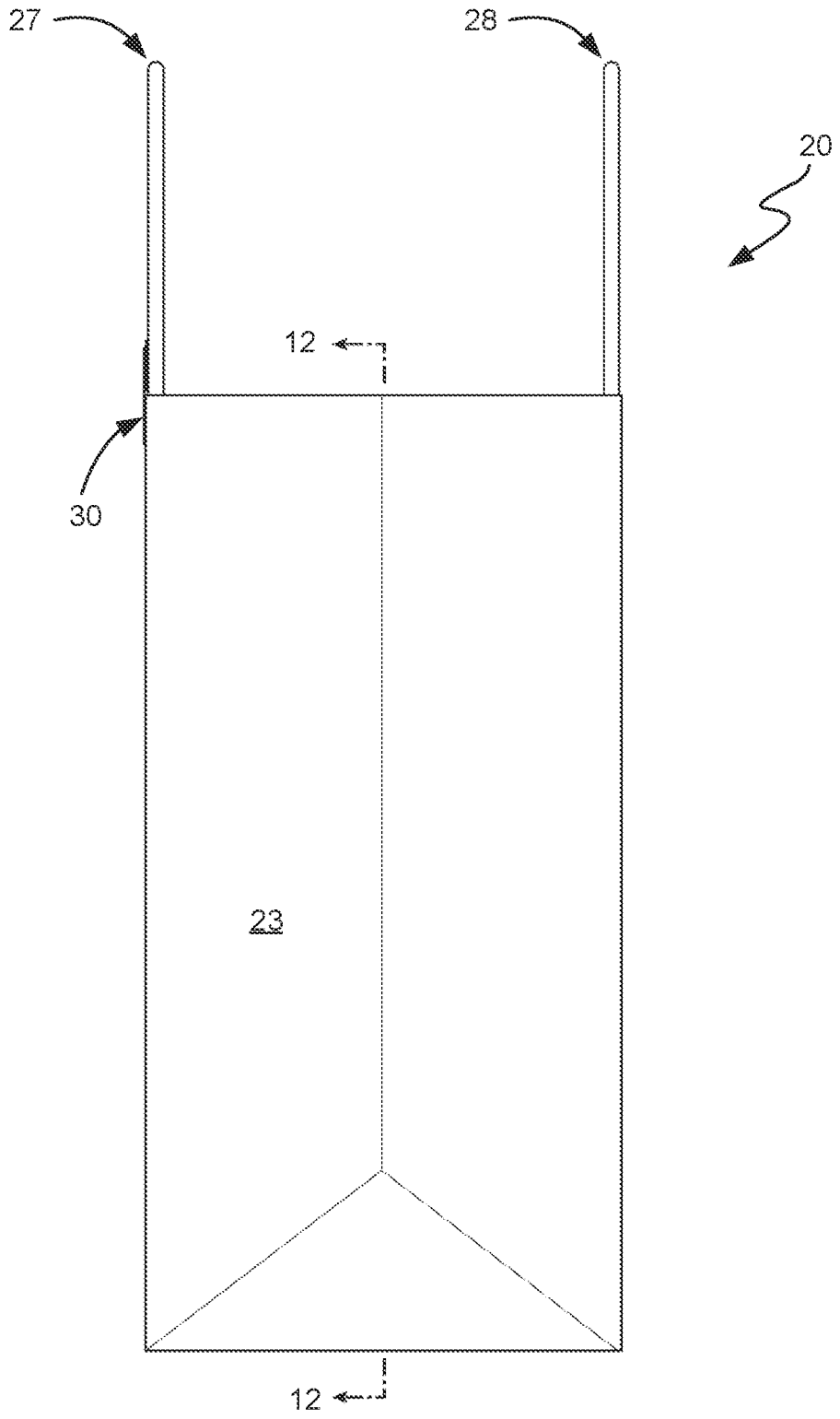
FIG. 11 is a right side elevation view of the bag assembly of FIG. 9.
Figure 12:
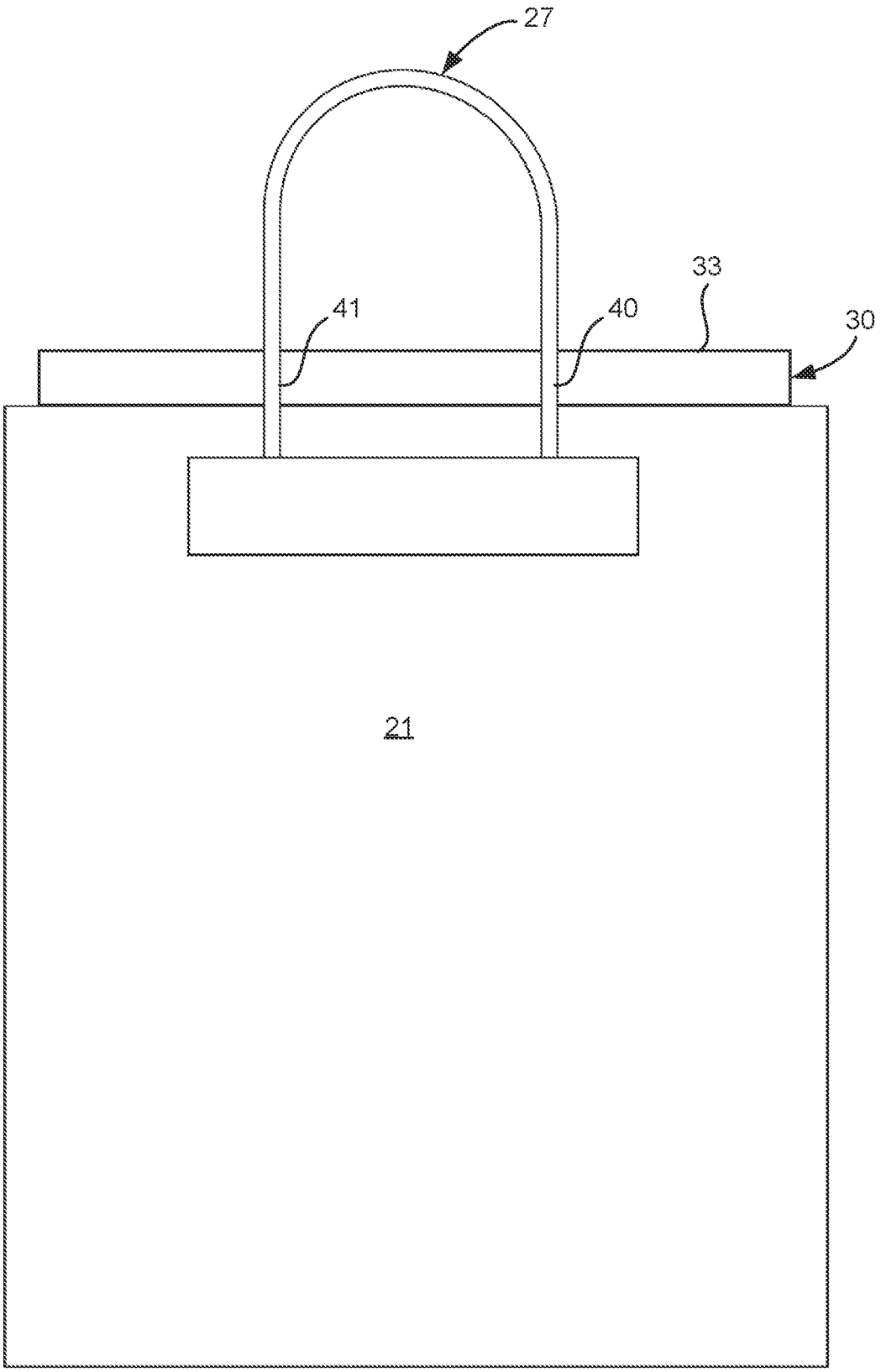
FIG. 12 is a fragmentary, rear elevation view taken along the plane of the line 12-12.
Figure 13:
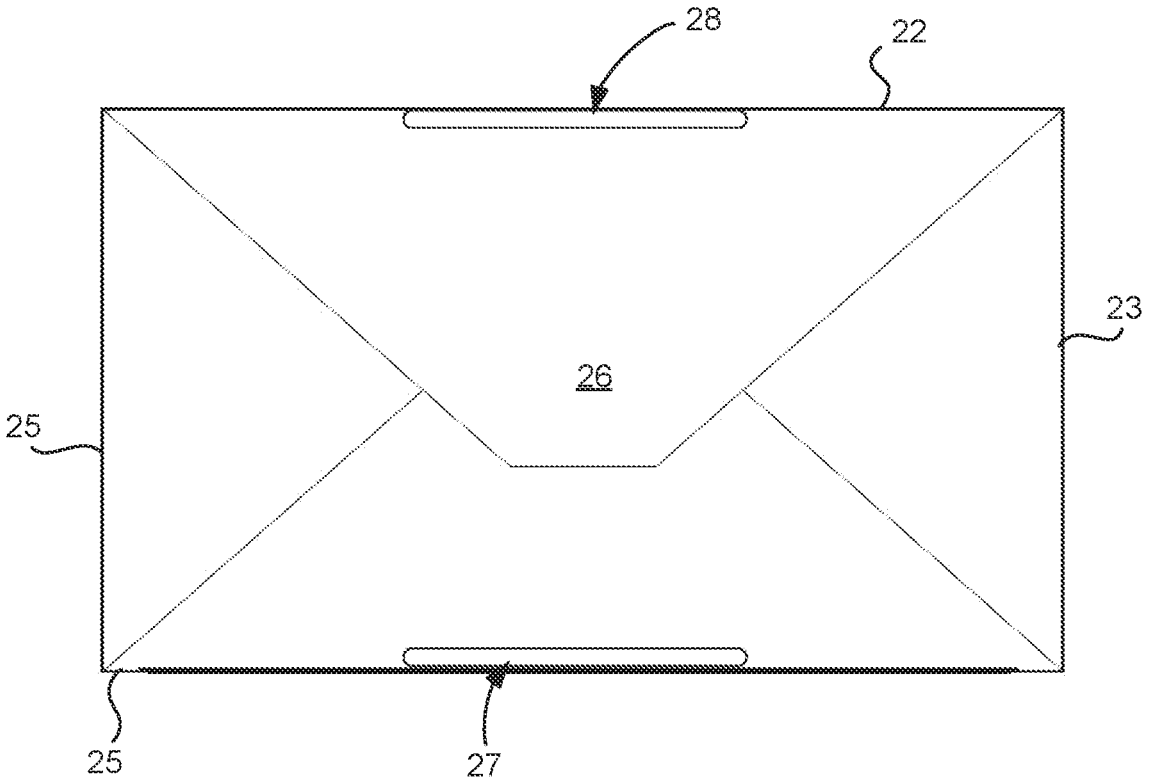
FIG. 13 is a top plan view thereof.
Figure 14:
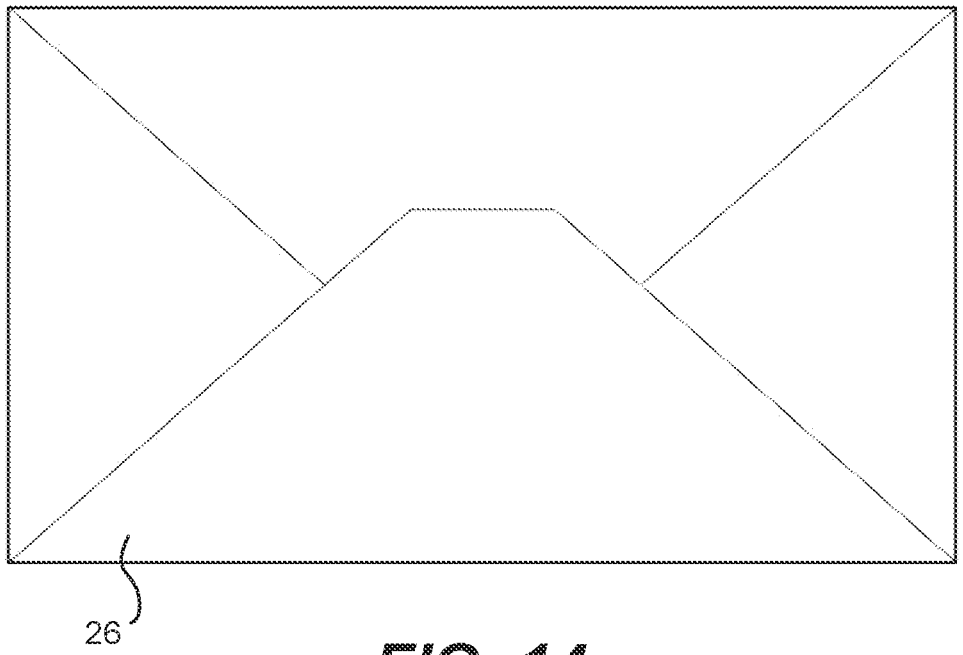
FIG. 14 is a bottom plan view thereof.

Turning now to FIGS. 1-8, a tamper evident delivery bag assembly, generally designated 20, is provided having a sheet-like first panel 21, an opposed sheet-like second panel 22, and a bottom gusset 26. Each the first and second panel 21, 22 having an interior surface that faces the opposing panel and an exterior surface. Moreover, each panel 21, 22 further includes a respective upper section 36, 37 terminating at an upper first edge 31 of the first panel 21, and an opposed upper second edge 32 of the second panel 22. The first and second edges 31, 32 cooperating to at least partially define a bag opening 35 into a content receiving region extending between the bag opening 35, panels 21, 22 and the bottom gusset 26. The upper sections 36, 37 being movable between an opened condition (FIGS. 1-5) and a closed condition (FIGS. 6-8), orienting the first and second edges 31, 32 generally in opposed, adjacent, relationship to one another. The bag assembly further includes a first handle 27 mounted to the upper section 36 of the first panel 21, and includes a pair spaced-apart first leg portions 40, 41 upstanding from the first edge 31. A second handle 28 is also included which is mounted to the upper section 37 of the second panel 22, and also includes a pair spaced-apart second leg portions 42, 43 upstanding from the second edge 32. The first and second leg portions 40, 41 and 42, 43 being generally aligned adjacent one another when the upper sections 36, 37 are oriented in the closed condition (FIGS. 6-8). In accordance with the present invention, the bag assembly further includes a single use closure tape member 30 laterally mounted to the first panel upper section 36, and having an upper lateral portion extending laterally above the first edge 31 thereof in an unsealed condition (FIGS. 1-6). The tape member 30 further includes a closure adhesive 38 (FIG. 3) disposed on an interior surface of the tape upper lateral portion facing the second panel 22 when in the unsealed condition. The tape upper lateral portion includes a pair of handle cutouts 45, 46 strategically aligned with the respective leg portions 40, 41 of the first handle 27. A removable protective strip 33 is provided that covers the adhesive 38. When the protective strip 33 is removed, and the panel upper sections 36, 37 are aligned in the closed condition (FIG. 3), the tape upper lateral portion can be folded over the second edge 32 of the second panel 22 such that the adhesive is brought into contact with the exterior surface of the second panel 22, substantially sealing the bag opening in a sealed condition (FIGS. 7 and 8). In this arrangement, the leg portions 40, 41 and 42, 43 of the first and second handles 27, 28 are received through the respective handle cutouts 45, 46 of the tape member 30.

Accordingly, a single-use, tamper evident delivery bag assembly is provided that can be one-time sealed in a manner that will exhibit visible signs of tampering and destruction should someone attempt to access its contents, yet provides venting of the contents simply by the positioning of the closure adhesive and seal in such a manner to create venting. This single-use bag assembly is particularly useful in the food delivery service industry since the size of the vent or vents, while providing venting of steam for example, is sufficiently small so that delivery personal cannot tamper with the bag contents without tearing of the bag or seal.

Figure 17:
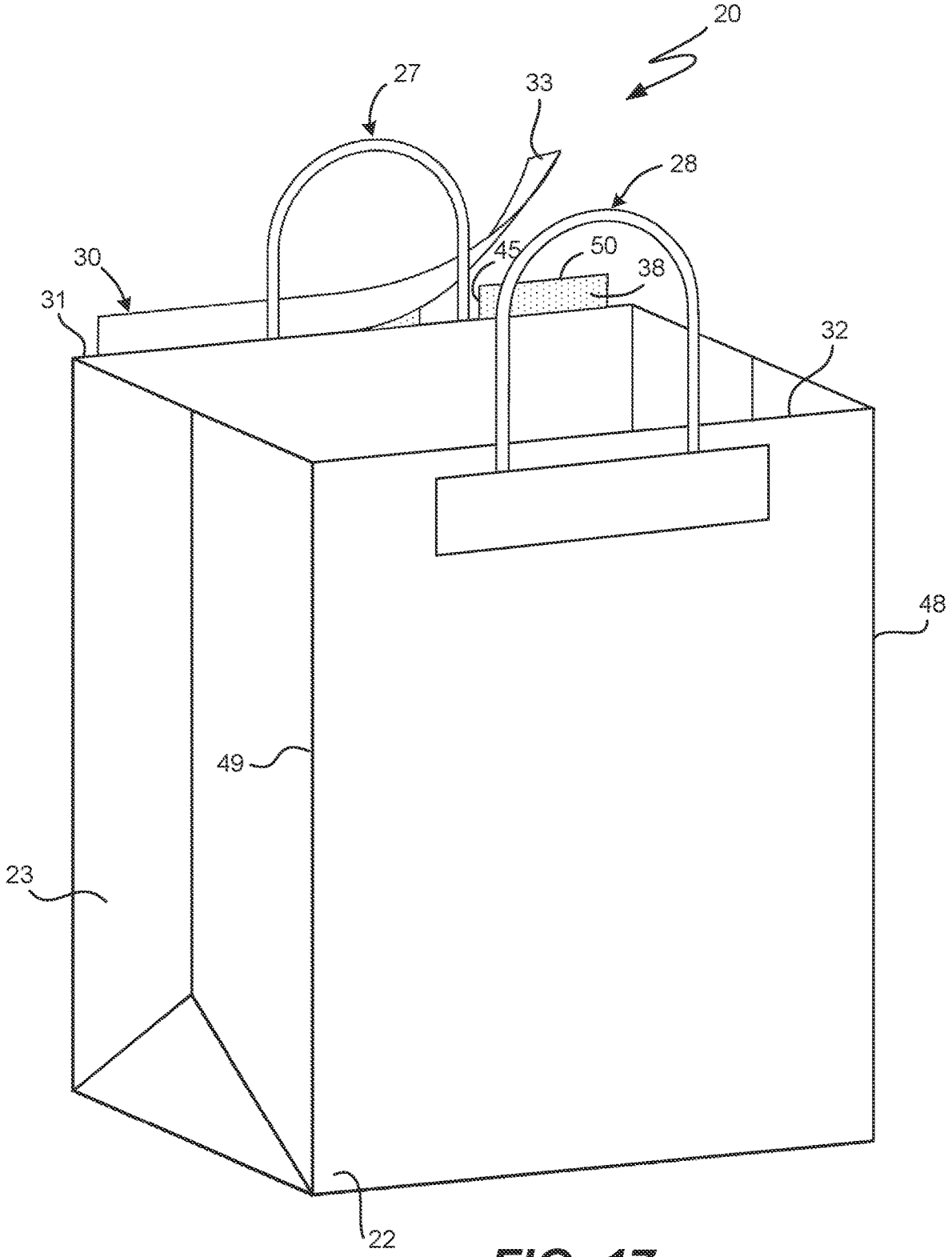
FIG. 17 is rear perspective view of an alternative embodiment of the bag assembly of FIG. 1, illustrating exterior mounted handles.

In accordance with the present invention, the delivery bag assembly 20 includes a fairly conventional handled bag assembly with the sheet-like first panel 21 and the opposed sheet-like second panel 22 either directly joined at the opposed panel side edges 44, 47 and 48, 49, forming common opposed side seams (not shown) or joined at respective panel side edges by an opposed pair of sheet-like, vertically creased, side gussets 23, 25 therebetween. The folded sheet-like bottom gusset 26 is coupled to the bottom edges of the first and second panels 21, 22, and the bottom edges of the opposed side gussets 23, 25. The respective interior surfaces of the first and second panels 21, 22, the side gussets 23, 25, and the bottom gusset 26 collectively define the content receiving region. Moreover, the pair of opposed handles 27, 28 are preferably provided by conventional twisted loop handles, flat plastic or paper folded handles (FIG. 15), rope handles, etc., that are widely available for easy carrying. These handles 27, 28 each include a pair of leg portions 40, 41 and 42, 43 which are mounted to either, the respective interior surface (e.g., FIG. 3) or the exterior surface (e.g., FIG. 17) of the respective upper sections 36, 37 of the first and second panels 21, 22.

Briefly, it will be appreciated that while the present invention is particularly suitable for conventional handled paper bags, this tamper evident seal assembly can be applied to plastic bags as well as any other conventional bag materials utilized in the food delivery industry. Moreover, while the present invention is shown with bag assemblies with two handles, one mounted to each panel, it will be appreciated that the present invention applies to bag assemblies with only a single handle (e.g., only a single handle 27 mounted to the first panel 21, and no second handle 28 mounted to the second panel 22).

Figure 2:
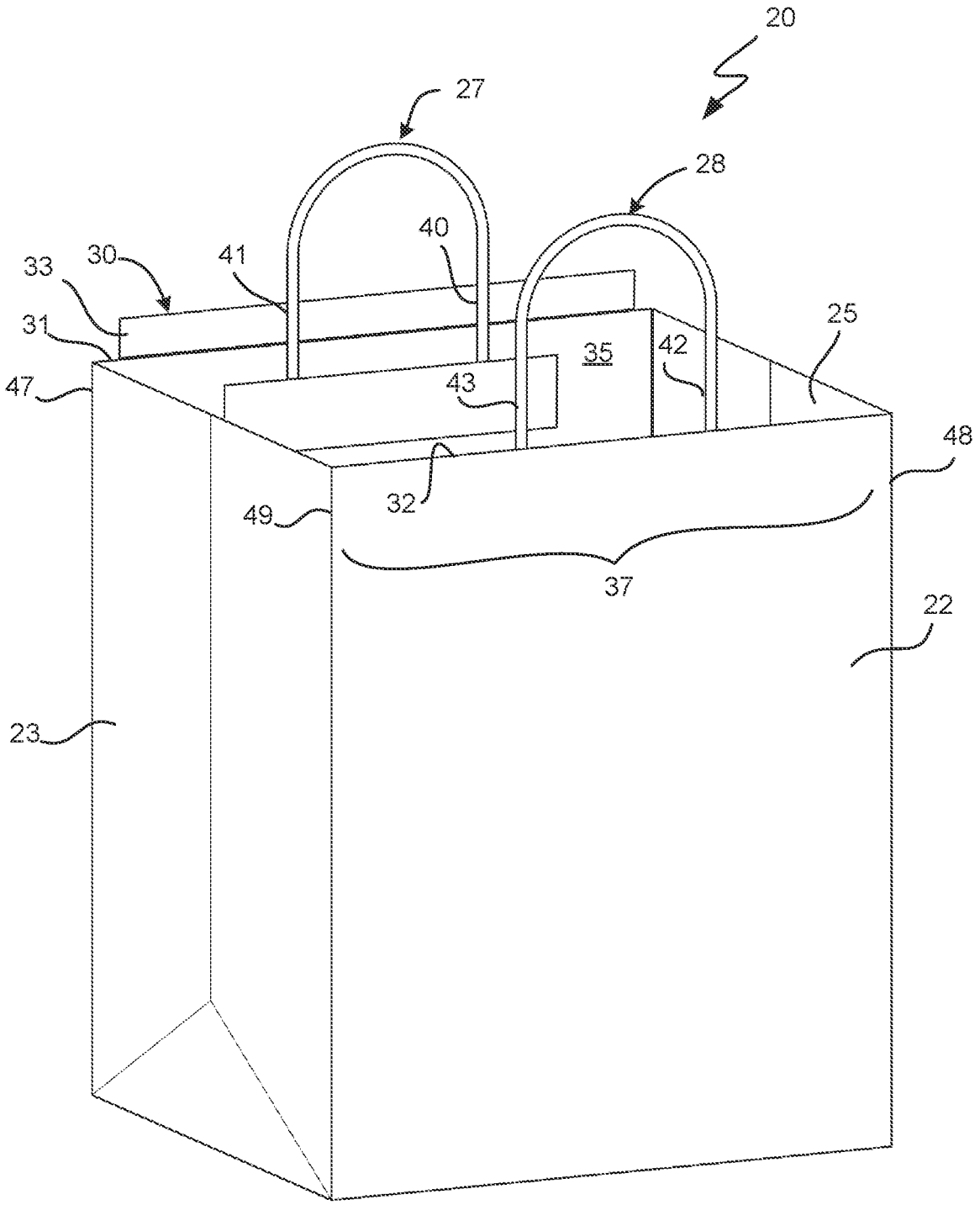
FIG. 2 is a rear perspective view of the bag assembly of FIG. 1, illustrating a tape member in an unsealed condition.
Figure 3:
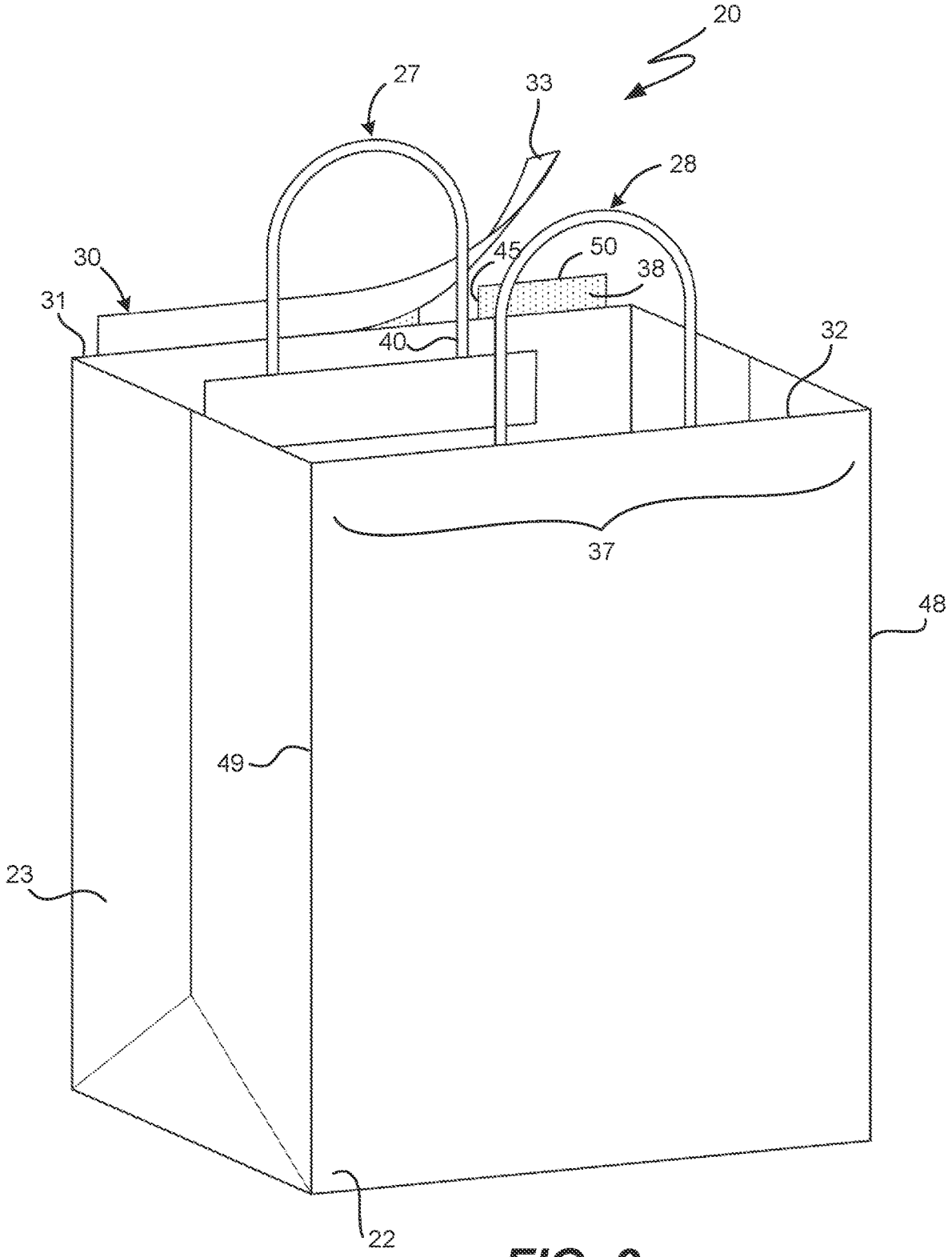
FIG. 3 is a rear perspective view thereof, illustrating removal of a protective strip from an adhesive of the tape member
Figure 4:
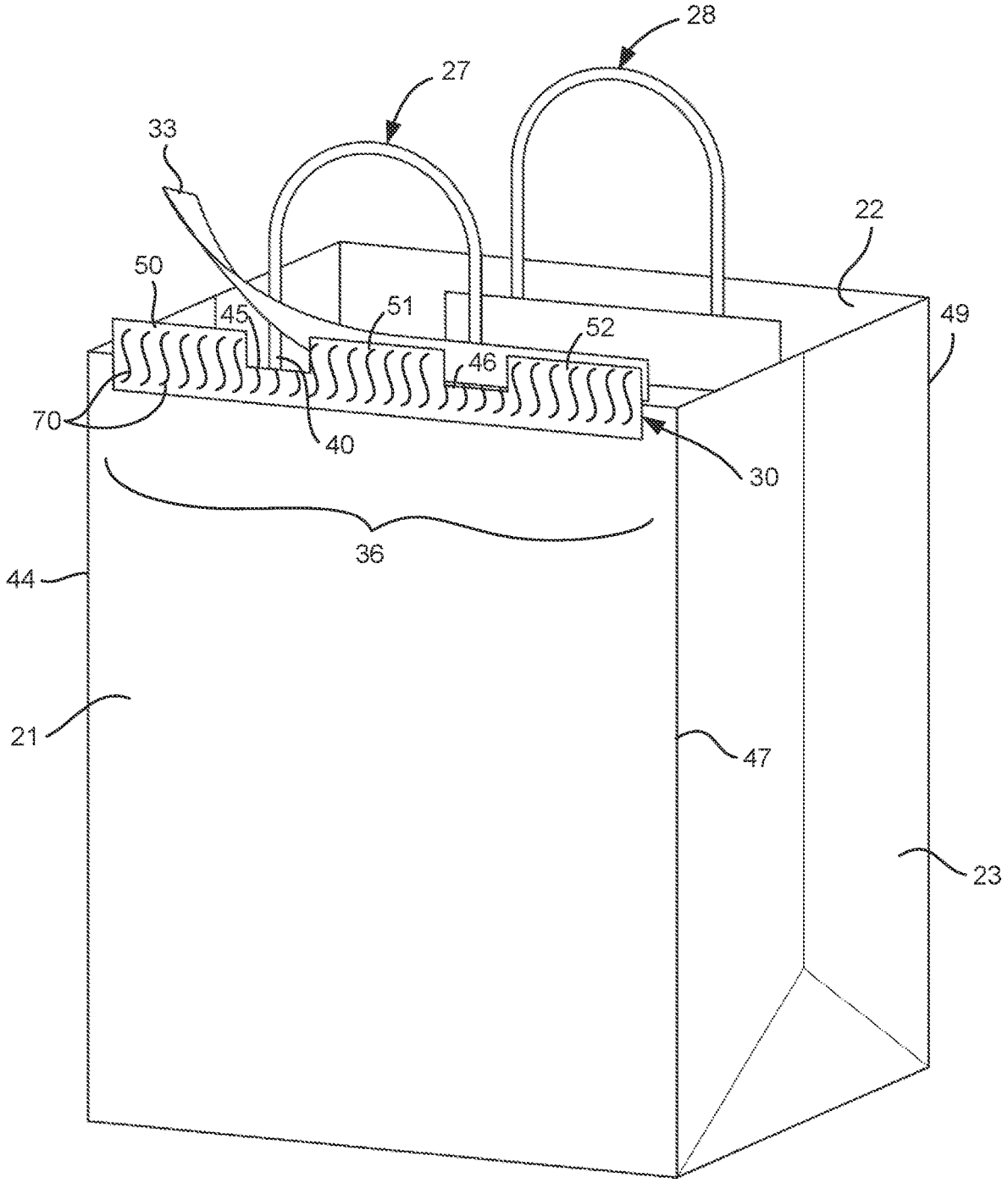
FIG. 4 is a front perspective view of the bag assembly of FIG. 3.
Figure 5:
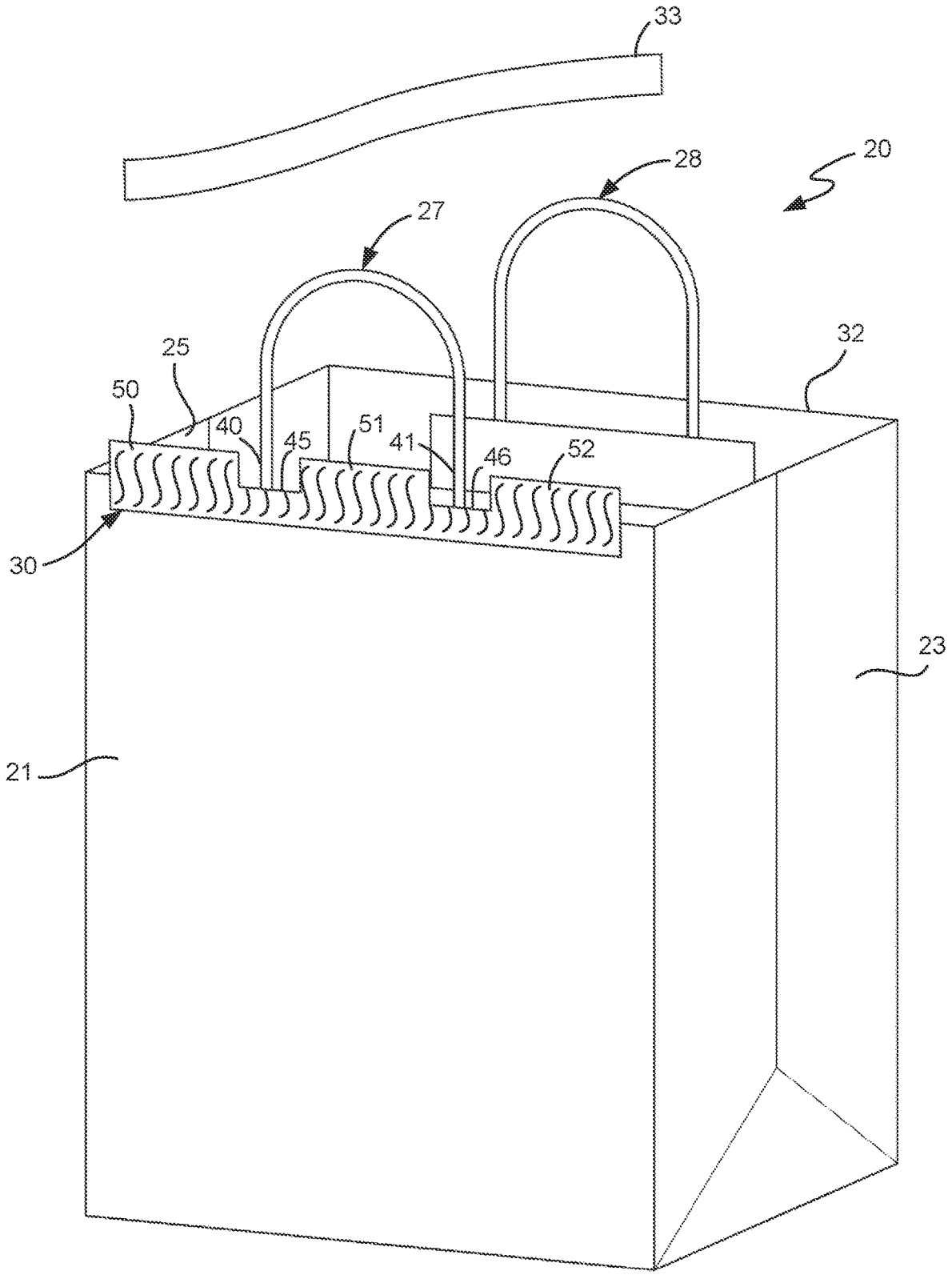
FIG. 5 is an exploded, front perspective view of the bag assembly of FIG. 4, illustrating the protective strip fully removed.
Figure 15:
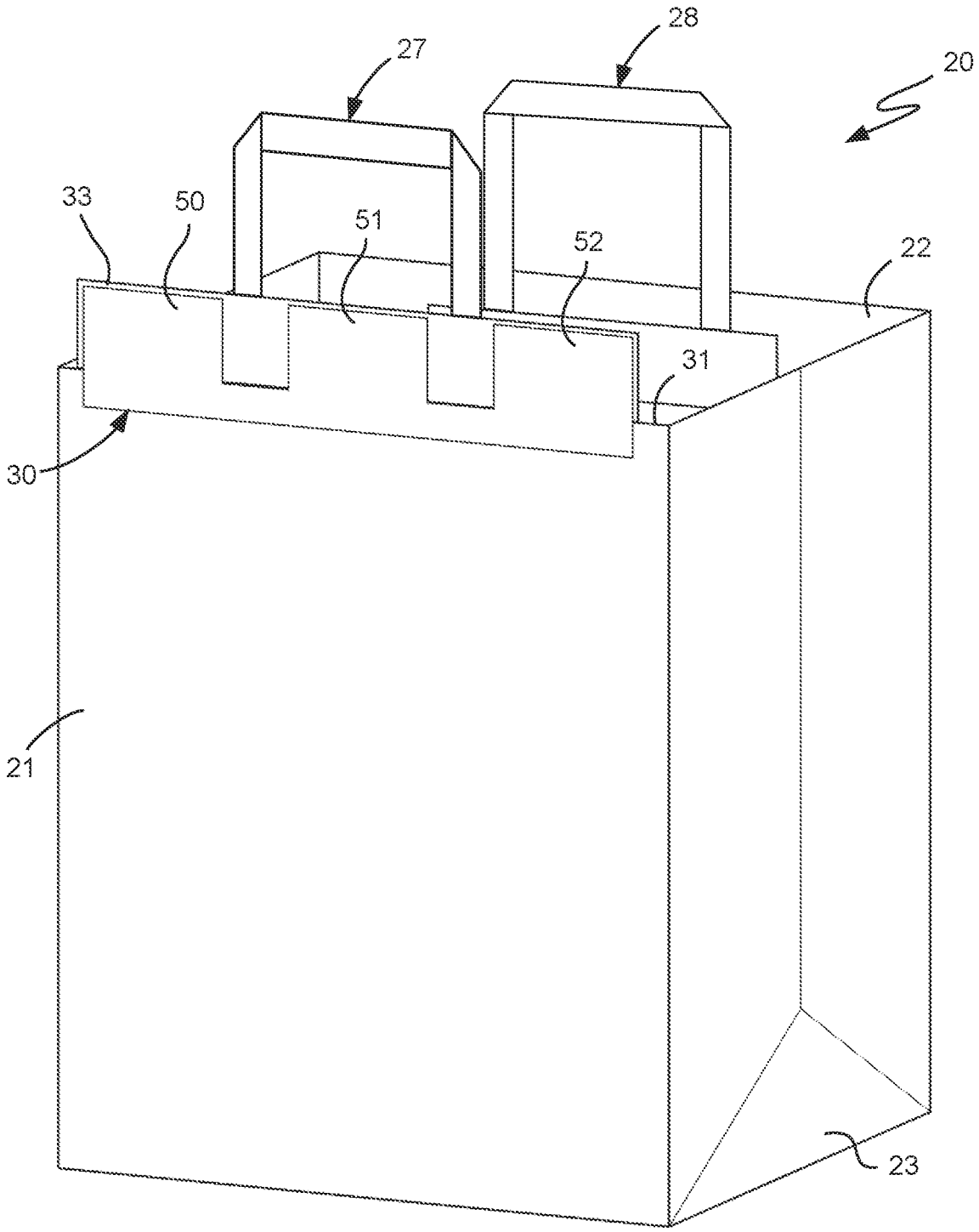
FIG. 15 is an alternative embodiment sealable bag assembly.
Figure 16:
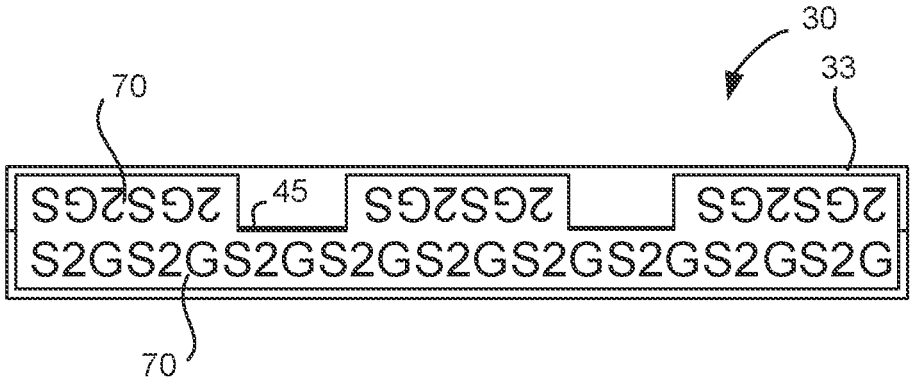
FIG. 16 is a top plan view of the tape member.

Referring now to FIGS. 1, 2 and 16, the bag assembly 20 includes an elongated, single-sided adhesive or tape member 30 mounted to the exterior surface, and at the first and second edges 31, 32 of either the sheet-like first and second panel 21, 22. For the sake of clarity, the tape member will be described with reference to mounting, initially, only to the exterior surface of the first panel 21, although it will be appreciated that the tape member could be mounted to the exterior surface of the second panel 22 or to either interior surfaces thereof. Hence, the elongated tape member 30 is initially adhered or mounted to the exterior surface of the first panel 21, extending laterally along the corresponding upper first edge 31 thereof. In general, less than about one-half of the tape member 30 (i.e., a lower lateral portion thereof) is positioned below the corresponding first edge of the first panel 21, while being mounted to exterior surface thereof. The remaining upper lateral portion of the tape member 30 extends above the corresponding first edge 31, in the unsealed condition (FIGS. 1-6), and is initially not mounted or adhered to anything other than its protective strip 33. In one example, as shown in FIGS. 1, 4-6 and 9, the height of the lower lateral portion (mounted to the exterior surface of the first panel 21) and that of the upper lateral portion of the tape member 30 are generally equal to one another. In another example, as shown in FIG. 15, the height of the upper lateral portion may be significantly higher than that of the lower lateral portion. For instance, the height of the lower lateral portion may be ½" while that of the upper lateral portion is 1½" above the first edge 31.

The remaining upper lateral portion of the tape member 30 is configured to be folded over the opposing second edge 32 of the second panel 22 (FIG. 5), when the opening 35 into the bag interior of the bag is positioned in a closed condition (FIG. 6), prior to sealing of the opening in a sealed condition (FIGS. 7 and 8). It will be appreciated that in this closed position, the opposed first and second edges 31, 32 of the sheet-like first and second panels 21, 22, as well as the handles 27, 28, will be oriented generally parallel to and adjacent one another.

Referring now to FIGS. 1 and 4-6, to accommodate the lower leg portions 40, 41, 42, 43 of the opposed handles 27, 28 that are mounted to the corresponding first and second panels 21, 22, the upper lateral portion of the tape member 30 includes corresponding handle cutouts 45, 46 aligned therewith. These aligned handle cutouts 45, 46 separate the remaining upper lateral portion into three closure sections 50, 51 and 52, enabling the tape upper lateral portion to be folded over the corresponding second edge 32 of the second panel 22. Accordingly, once the protection strip 33 has been removed (FIGS. 5 and 6), as will be described in greater detail below, the exposed adhesive 38 on each closure section of the tape member can be adhered to the corresponding exterior surface of the second panel upper section, thereby sealing the bag closed in a sealed condition (FIGS. 7 and 8).

It will be appreciated that the handle cutouts 45, 46 can be any shape, but must be sufficiently dimensioned to accommodate the lower leg portions 40-43 of the handles 27, 28 when the panel upper sections are oriented in the closed condition and the tape member is in the sealed condition. Moreover, it will be understood that integral cutout vent apertures 60, 61 into the bag interior are formed by the cutouts themselves when the tape member seals the bag opening (FIGS. 7 and 8). Thus, these vent apertures 60, 61 are essentially formed between the interior distal edges of the outer closure sections 50, 52 of the tape member 30 and the first and second edges 31, 32 of the corresponding panels 21, 22.

Further, the outer vent apertures 62-65 are formed by the spacing between the outer distal edges of the outer closure section 50, 52 of the tape member 30 and the corresponding opposed side edges of the first and second panels 21, 22, as the tape member extends across roughly about 90% the width of the first and second panels. In this manner, when the outer closure sections 50, 52 of the tape member are sealed against the exterior surface of the second panel 22, the distal ends of the tape member 30 and the end creases of the corresponding folded side gussets 23, 25 form these four outer vent apertures 62-65. In contrast when the opposed side edges 44, 47 and 48, 49 of the panels 21, 22 are directly joined at side seams (not shown) whereby the upper side gussets are eliminated, only two outer vent apertures are formed between the outer distal edges of the tape outer closure section 50, 52 and the corresponding joined side edges of the panels.

Collectively, these vent apertures provide venting of contents sealed within the bag interior. This will of course assures proper steam venting of hot food content therein, for instance, when the bag assembly is being carried by the handles 27, 28. It will be appreciated, however, that each vent aperture or passage is of a lateral dimension sufficiently large to enable adequate venting of steam therethrough while being sufficiently small to prevent the passage of a human hand therethrough. These vent apertures are preferably in the range of opening to at least about 3.2 mm in diameter to no more than about 25.4 mm in diameter, and more preferably about 12.7 in diameter.

When the tape member 30 is folded over, using the adhesive 38 to seal off the bag opening, the bag assembly is temporarily closed while retaining the container contents in the content receiving region. The adhesive 38 of the tape member will maintain the closure of the bag assembly until forcibly opened and/or torn. Accordingly, a tamper evident seal is created, assuring both the food preparer/provider, the food delivery driver, and the customer that content contained in the bag assembly 20 has not been tampered with.

The character and properties of the adhesive of the closure tape member 30 is preferably similar to that of the relatively strong adhesives and adhesive tapes employed for those used on overnight delivery packages, for instance. That is, the adhesive strength must be sufficiently strong so that any attempt to open the sealed bag assembly would show visible signs of tampering (e.g., stretching, tearing, etc. of the bag material and/or closure adhesive). Suitable closure adhesive tape materials include, for example, 3M® 9086, 9888T, CT6348, 9088, 9088FL, and 55256 double-sided adhesive.

To prevent inadvertent closure or contact of the adhesive 38 of the remaining upper lateral portion of the tape member 30, as mentioned, the tape member 30 includes a manually removable protective strip 33 (FIGS. 1-4). Thus, the adhesive 38 of the closure sections 50, 51, and 52 are protected until needed and utilized. Generally, however, even when the protective strip is removed released from the tape member 30, the adhesive, when still oriented in the unsealed condition, will not inadvertently contact the exterior surface of the second panel 22 until the tape upper lateral portion is manually folded over the first and second edges of the bag, and sealed against the second panel.

In accordance with the present invention, a single unit protective strip 33 is applied, spanning the voids created by the handle cutouts 45, 46 of the upper lateral portion of the tape member. In this manner, the protective strip can be removed as one unit rather than removing three separate units. This significantly reduces the time and effort required to remove the protective strip during sealing the bag assembly 20.

In one configuration, the tape member 30 includes strategic cuts or scoring 70 (e.g., FIGS. 1, 4 and 16) to easily cause breakage of the tape member should removal of the tape be attempted. Such scoring, thus, easily shows any evidence of tampering due to visual separation of the scored portion of the tape member 30 should tampering of the tape member be attempted. While the scoring 70 is shown in the figures as a plurality of adjacent S-shaped slits that extend traversely across the tape member, the scoring marks can be provided by any convention designs. For example, the slits may be in the form of designs. In one specific example, more distinctive designs include lettering or the like, and can provide personal advertising such as the "S2G" design (Seal-2-Go) shown in FIG. 16.

In another aspect of the present invention, the tape member 30, alone, may be provided for mounting of the lower lateral portion of the tape member to the upper section 36 of the first panel 21 (FIG. 16). The tape member would be provided with pre-cut handle cutouts 45, 46 that are to be aligned with the leg portions 40, 41 of the first handle 27. In this configuration, the tape member includes a lower protective cover 34 similar to the protective strip 33 that protects an adhesive mounted to the lower lateral portion (not shown). This protective cover 34 may removed prior to aligned adhered mounting of the lower lateral portion to the first panel upper section 36 without requiring removal of the protective strip 33.

In still another aspect of the present invention, a method is provided for tamper evident delivering of one or more food containers in a handled bag assembly 20. The method includes providing a handled delivery bag assembly 20 having a sheet-like first panel 21, and an opposed sheet-like second panel 22. Each the first and second panel includes an interior surface that faces the opposing panel and an exterior surface. Each panel 21, 22 further includes a respective upper section 36, 37 terminating at an upper first edge 31 of the first panel and an opposed upper second edge 32 of the second panel. The first and second edges 31, 32 cooperate to at least partially define a bag opening 35 into a content receiving region extending between the bag opening and the first and second panels 21, 22. The upper sections 36, 37 are movable between an opened condition (FIGS. 1-5) and a closed condition (FIGS. 6-8), orienting the first and second edges 31, 32 generally in opposed, adjacent, relationship to one another. The bag assembly further includes a first handle 27 mounted to the upper section 36 of the first panel 21 having a pair spaced-apart first leg portions 40, 41 upstanding from the first edge 31, and a second handle 28 mounted to the upper section 37 of the second panel having a pair spaced-apart second leg portions 42, 43 upstanding from the second edge 32. The first and second leg portions are generally aligned adjacent one another when the upper sections 36, 37 are oriented in the closed condition (FIGS. 6-8). The bag assembly further includes a single use closure tape member 30 laterally mounted to the first panel upper section 36, and having an upper lateral portion extending laterally above the first edge 31 thereof in an unsealed condition (FIGS. 1-6) wherein the tape upper lateral portion having a pair of handle cutouts 45, 46 strategically aligned with the leg portions 40, 41 of the first handle 27. The method further includes reorienting the upper sections 36, 37 of the bag assembly 20 to the opened condition (FIGS. 1-5) to enable receipt of the one or more food containers in the content receiving region, and repositioning the upper sections of the bag assembly from the opened condition to the closed condition (FIGS. 6-8). This orients the first and second edges, and the leg portions of the handles, generally in opposed, adjacent, relationship to one another. Next, the method includes exposing a closure adhesive 38 disposed on an interior surface of the tape upper lateral portion facing the second panel 22 when in the unsealed condition, and folding the tape upper lateral portion over the second edge 32 of the second panel 22 such that the adhesive is brought into contact with the exterior surface of the second panel, substantially sealing the bag opening 35 in a sealed condition (FIGS. 7 and 8). In this manner, the leg portions 40-43 of the first and second handles are received through the respective handle cutouts 45, 46 of the tape member 30.

In one specific embodiment of this aspect of the present invention, the exposing the closure adhesive 38 includes removing a protective strip 33 from the closure adhesive.

Figure 18:
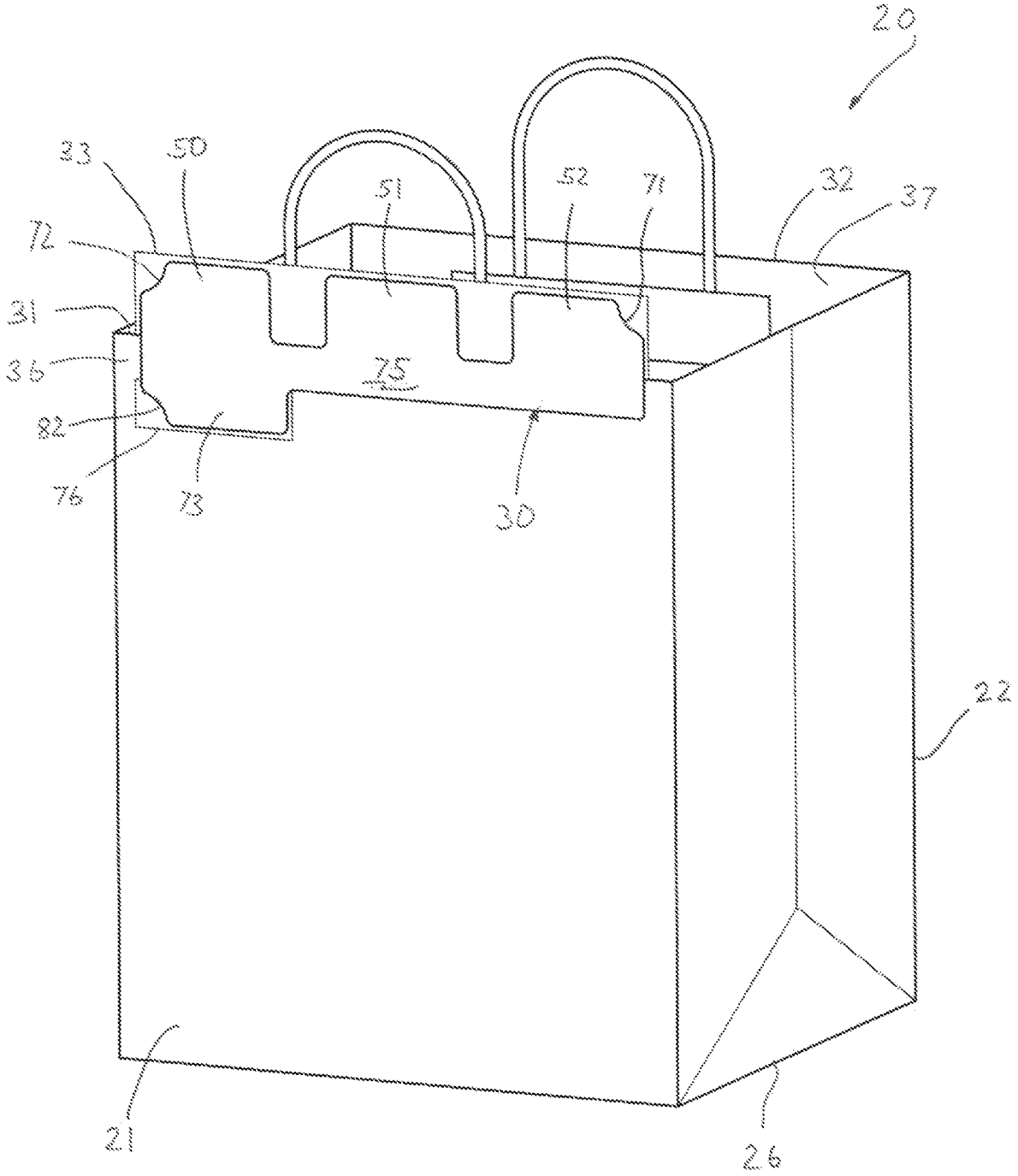
FIG. 18 is a front perspective view of an alternative embodiment of the bag assembly of FIG. 1 in the opened condition, and having a note tab and closure cutouts.
Figure 22:
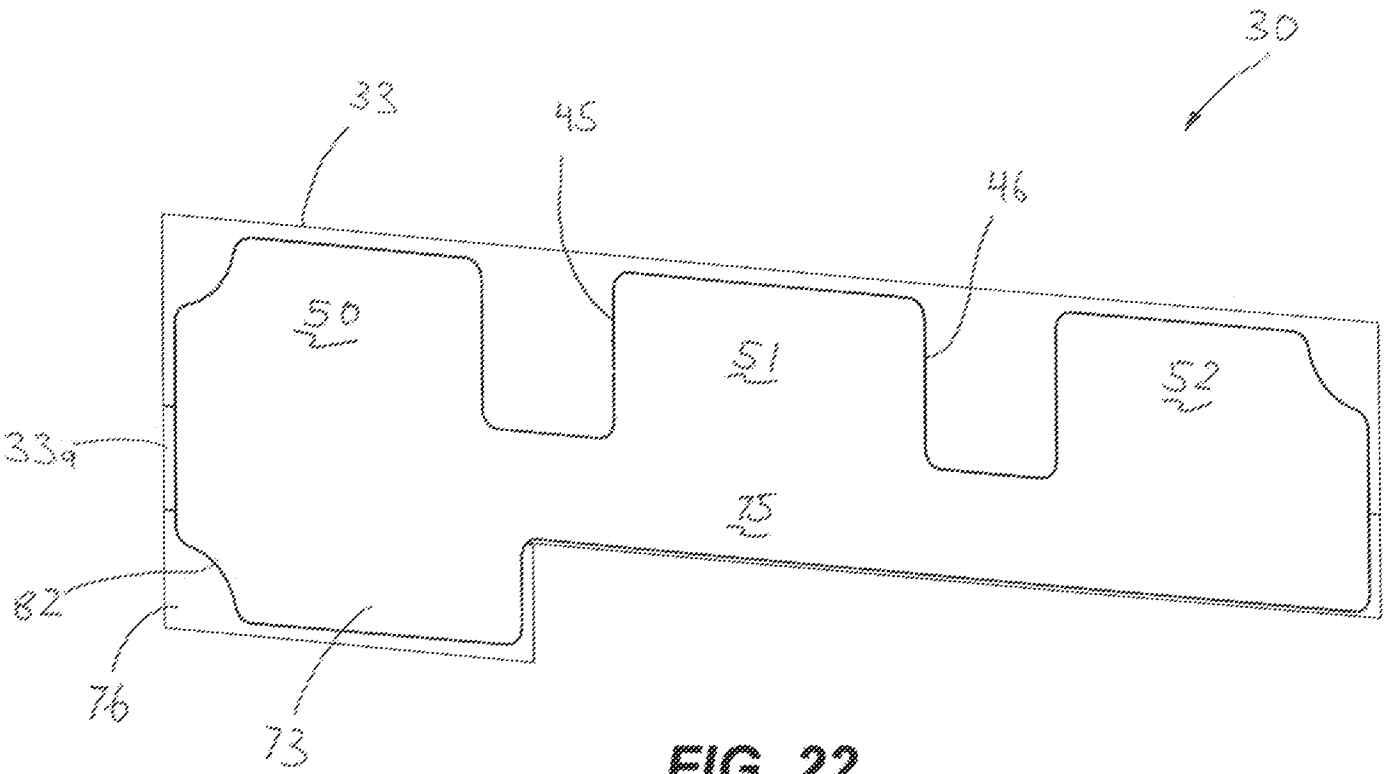
FIG. 22 is an enlarged, front perspective view of an individual, unmounted, tape member for the bag assembly of FIG. 18, having a protective strip and protective covers mounted thereto.

In another aspect of the present invention, as shown in FIGS. 18 and 22, the outer closure sections 50, 52 of the tape member 30 include one or more closure cutouts 71, 72 that enable easier gripping of the protective strip 33 for removal thereof, to expose the underlying closure adhesive. These closure cutouts 71, 72 promote gripping of the protective strip 33 by providing an increased gripping surface area thereof. These cutouts 71, 72 are preferably located either at the corners of the outer closure sections (e.g., section 52) or more central to the far edge thereof (e.g., outer closure section 50). Such closure cutouts or recesses can be any shape or size, such as the quadrant closure cutout 71 or the semicircular or concave closure cutout 72, as long as a more significant gripping region of the protective strip 33 is exposed.

In yet another aspect of the present invention, tape member 30 includes a note tab 73 oriented on the side opposite the upper lateral portion which is configured to secure a note 74 (FIG. 21) or the like, such as a purchase receipt, order ticket or pick ticket, to the one of the bag assembly panels. This is very beneficial in that, in one example, the note 74 can be easily adhered to the designated bag assembly for simple viewing information such as the bag contents, consumer identification, order number and delivery destination, especially if the bag assembly has already been sealed.

Figure 19:
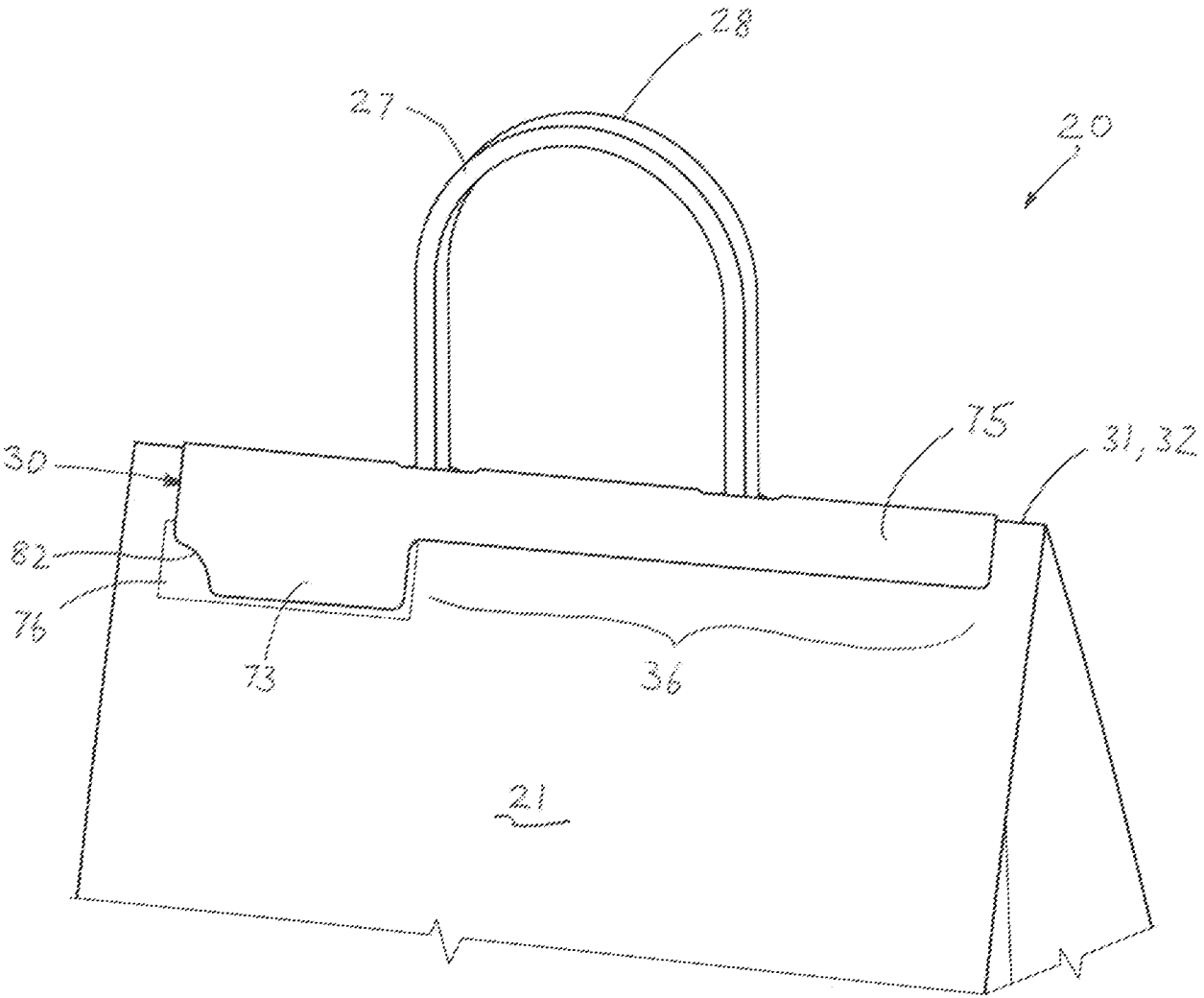
FIG. 19 is an enlarged, fragmentary, front perspective view of the bag assembly of FIG. 18 in the closed, sealed condition, and having the note tab in an unmounted condition.
Figure 20:
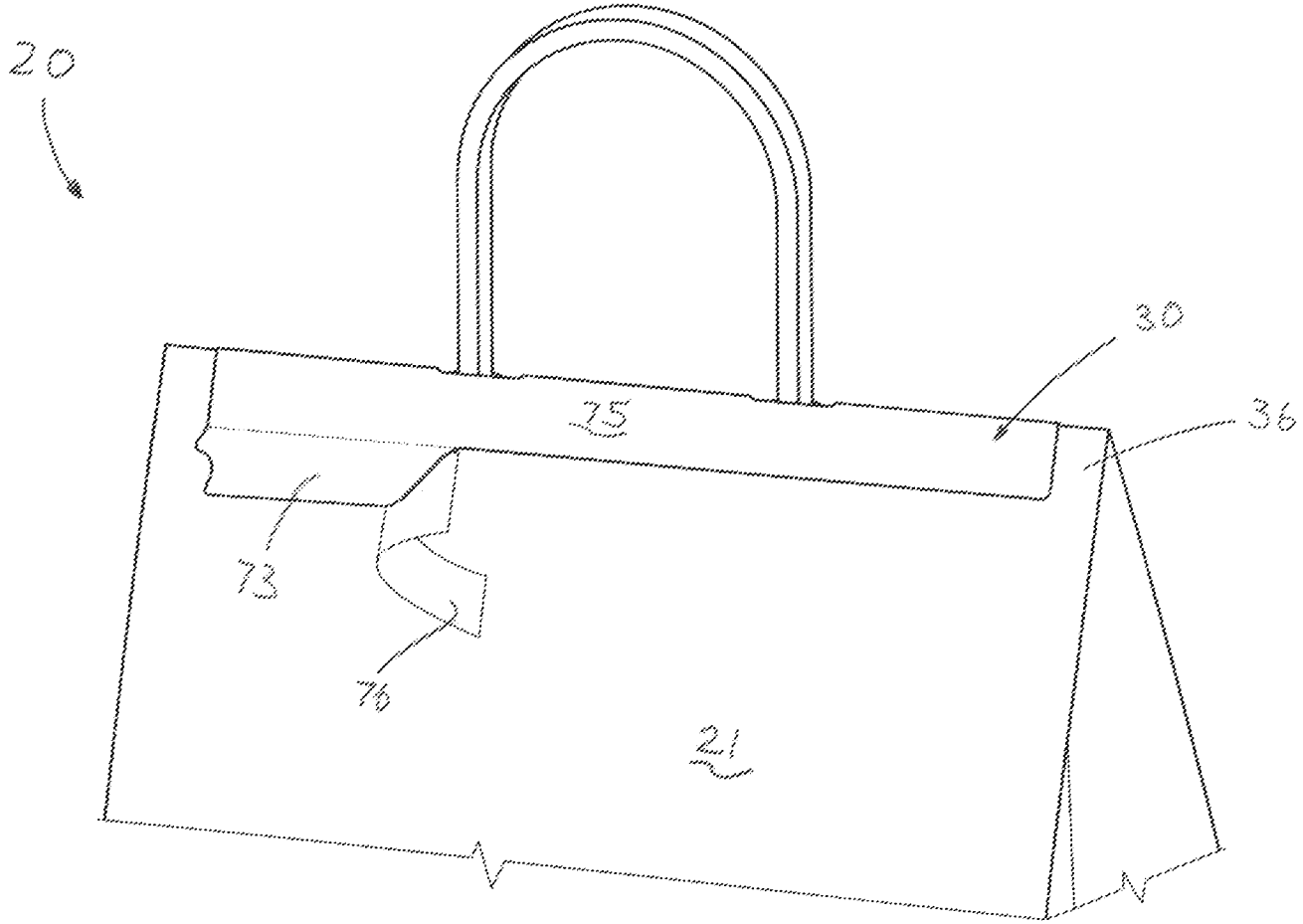
FIG. 20 is a fragmentary, front perspective view thereof, illustrating a protective strip being removed from the note tab.
Figure 21:
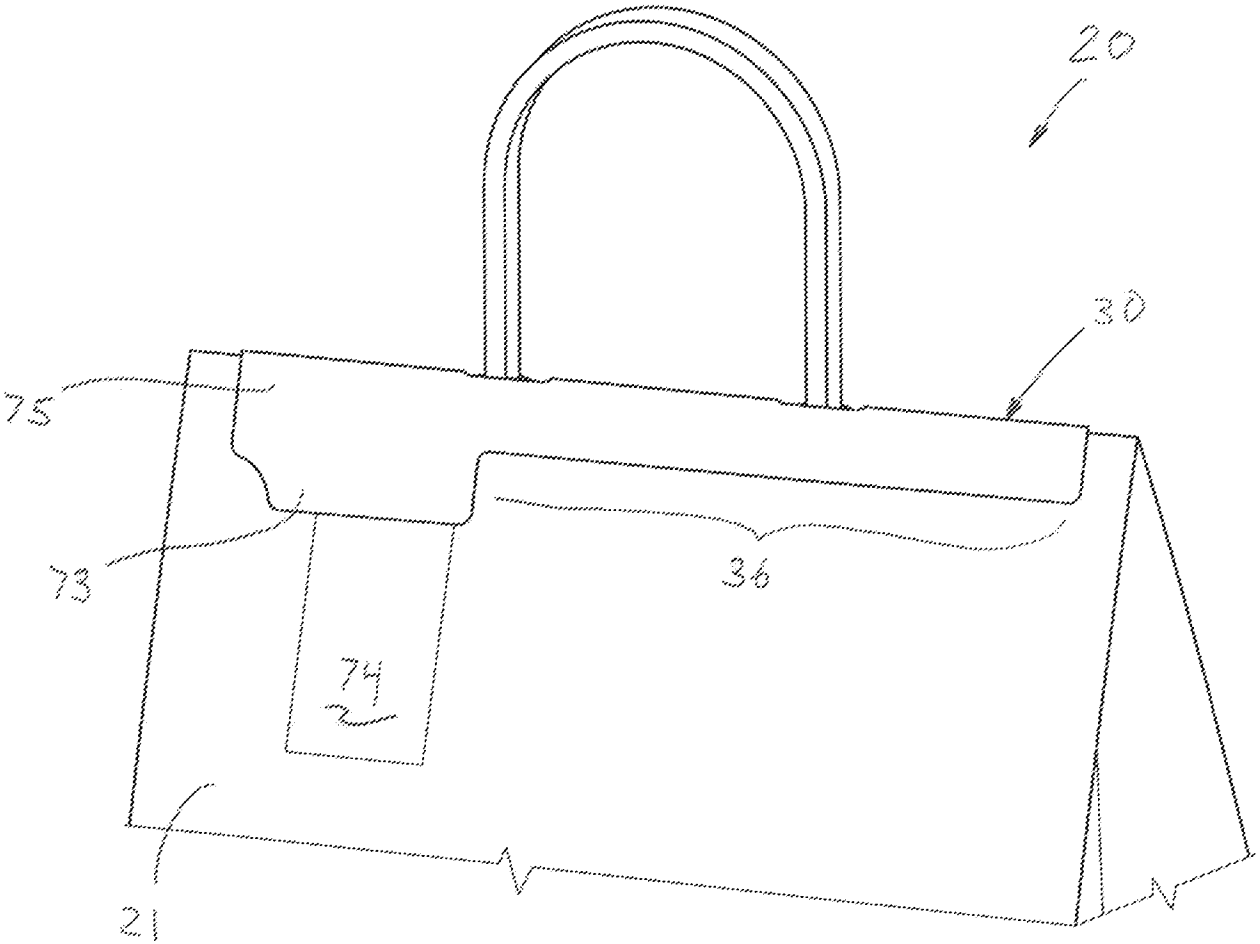
FIG. 21 is a fragmentary, front perspective view thereof, illustrating the note tab in a mounted condition, adhering a note to the bag assembly.

Accordingly, turning now to FIGS. 18-21, a tamper evident delivery bag assembly 20 is provided that is configured to further mount the note 74 thereon. Similar to the embodiments above, the bag assembly includes the sheet-like first panel 21, the opposed sheet-like second panel 22, and the bottom gusset 26. The upper sections 36, 37 of the first and second panels are movable between the opened condition (FIG. 18 and the closed condition (FIGS. 19-21), orienting the first and second edges 31, 32 generally in opposed, adjacent, relationship to one another. An elongated, single use closure tape member, generally designated 30, is laterally mounted to the first panel upper section 36 at a middle lateral portion 75 of the tape. The upper lateral portion of the tape member 30 extends laterally above the first edge of the first panel 21, in an unsealed condition (FIG. 18). The removable protective strip 33 is provided that covers the closure adhesive 38 disposed on an interior surface of the tape upper lateral portion. Again, similar to the above configurations, when the protective strip is removed, and the panel upper sections 36, 37 are aligned in the closed condition, the tape upper lateral portion can be folded over the second edge 32 of the second panel 22 such that the adhesive is brought into contact with the exterior surface of the second panel, substantially sealing the bag opening in a sealed condition (FIG. 19-21).

Figure 23:
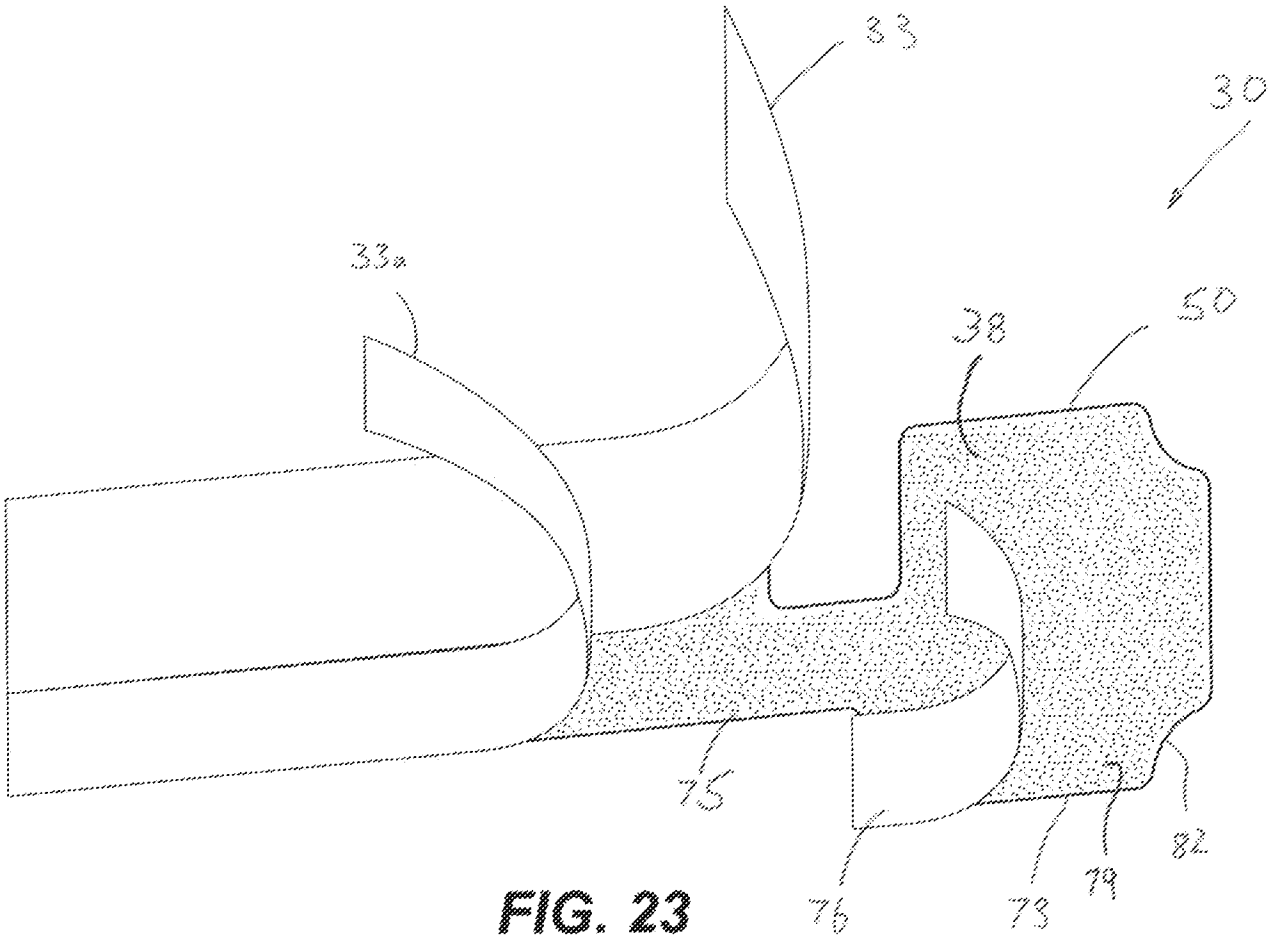
FIG. 23 is a rear perspective view thereof, illustrating removal of the protective strip and protective covers from an adhesive of the tape member

As best shown in FIGS. 22 and 23, the closure tape member 30 further includes a note tab 73 extending downwardly from the middle lateral portion 75 thereof. The note tab includes a tab adhesive disposed on an interior surface thereof facing the exterior surface of the first panel when in both an unmounted condition (FIGS. 18 and 19) and a mounted condition (FIG. 21), to be described. A removable protective cover 76 extends over and covers the tab adhesive, in the unmounted condition, preventing adherence of the note tab 73 to the exterior surface of the first panel 21. When the protective cover 76 is removed (FIG. 20), the note 74 can then be placed between the tab adhesive of the note tab 73 and the exterior surface of the first panel 21, and the note tab can be pushed into contact with the first panel 21, adhering the note tab therebetween, in a mounted condition (FIG. 21). Briefly, it will be appreciated that the tape member 30, prior to mounting to a bag or the like, will include a middle protective strip 33*a* that protects the adhesive on the backing of the middle lateral portion 75 prior to use.

The underside of the note tab 73 includes the tab adhesive 79 (FIG. 23) which is similar to the three closure sections 50, 51 and 52 on the opposite side of the tape member 30. In fact, the tape member is preferably stamped from a single tape source so that the upper lateral portion, the middle lateral portion 75 and the note tab 73 all have the same adhesive material backing, as well as the same protective cover materials. As mentioned, the removable protective cover 76 covers the tab adhesive so that the note tab 73 will not inadvertently adhere to the first panel exterior surface, maintaining the unmounted condition (FIGS. 18 and 19) until needed. This protective cover 76 is easily removed manually (FIG. 20) when the service personnel is ready to mount the note to the bag assembly. In accordance with the present invention, as best shown in FIG. 21, the note 74 can be adhered between the note tab 73 and the sheet-like first panel 21 of the bag assembly 20, mounting the same thereto, in the mounted condition.

The width of the note tab 73 is generally in the range of about ⅓ of the width of the middle lateral portion 75 of the tape member (as well as the first panel 21 width). This note tab width is variable, of course, and may even extend laterally across the entire width of the middle lateral portion 75, although this is perhaps not practical. The note tab width, however, must be wider than the note 74 itself since if note tab were too narrow, a wider note may span the entire width of the tab adhesive, preventing or impairing the ability of adhering the note tab to the exterior surface of the first panel 21. Accordingly, the width of the note tab is preferably at least in the range of about 1" to about 4".

Similarly, the height of the note tab can vary in any length, although too shallow of a height will render the tab unusable since it may be too difficult to position and adhere the note between the tab adhesive and first panel 21. On the other hand, a note tab 73 that is too tall in height is impractical to use, and wasteful of paper resources. Accordingly, the height of the note tab 73 is preferably in the range of about ¼" to about 1½".

Figure 25:
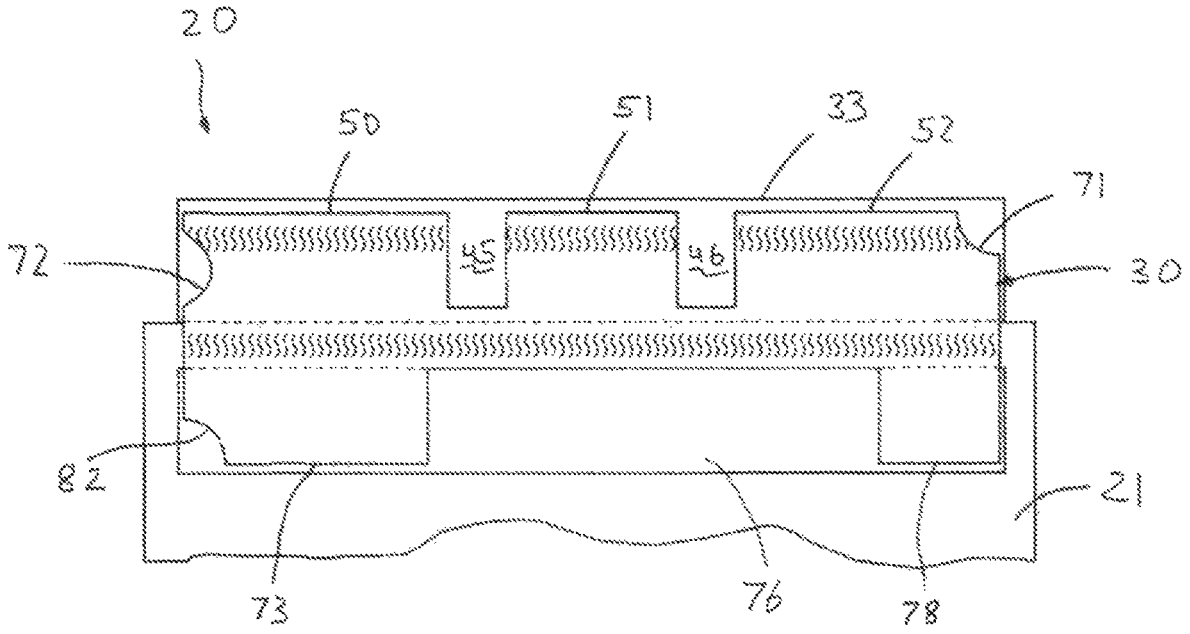
FIG. 25 is a fragmentary, front elevation view of yet another alternative embodiment having multiple note tabs.

For the most part, only one note tab 73 is be incorporated (FIGS. 18-23) along the bottom of the middle lateral section of the tape member 30. While this note tab is generally along one side or the other side along the bottom of the middle lateral portion 75 of the tape member 30, the note tab can be oriented central to the middle lateral portion 75 (FIG. 26) or even slightly offset from either end (not shown). The tape member 30 of the bag assembly 20 may also incorporate multiple note tabs 73, 77, 78 (FIGS. 25 and 26) of the same or differing sizes and shapes can be included extending laterally across the tape member. Furthermore, a single protective cover 76 (FIG. 25) or multiple independent protective covers 76, 80 and 81 can be utilized to protect the adhesive of the one or more note tabs 73, 77 and 78.

Figure 26:
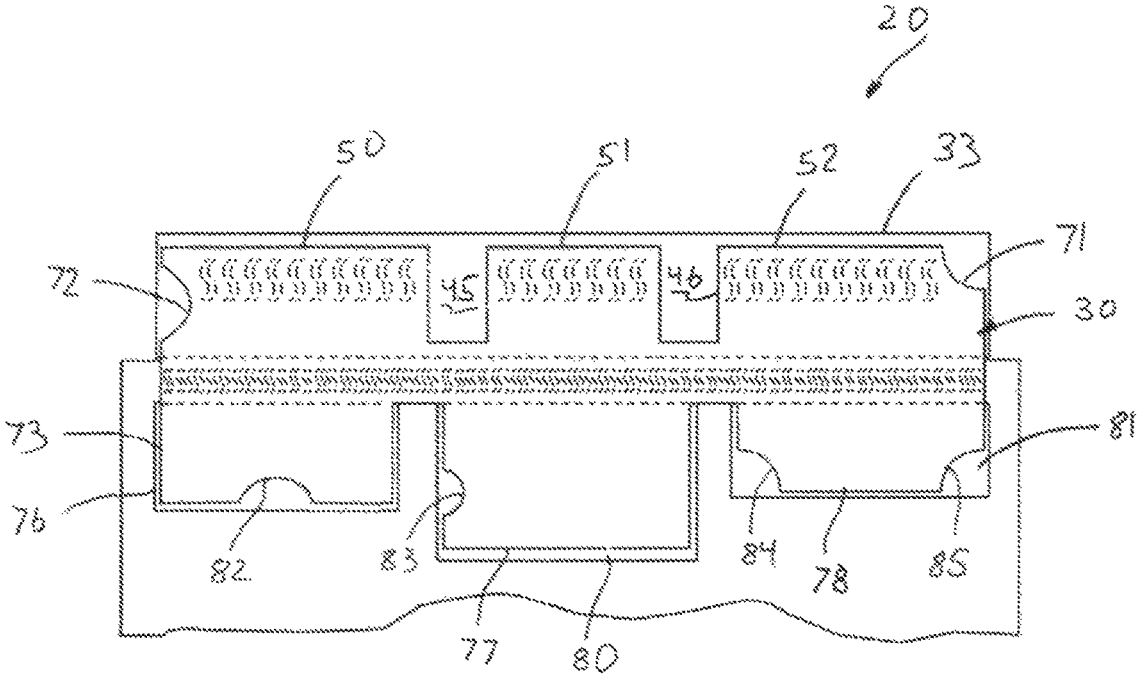
FIG. 26 is a fragmentary, front elevation view of still another alternative embodiment having multiple note tabs.

Similar to the closure sections, the note tab or tabs can include respective tab cutouts 82-85 that effectively promote gripping of the protective cover 76 by providing an increased gripping surface area to enable easier removal of the cover. These tab cutouts are preferably oriented at the corners of the note tab or tabs, but can be at the center thereof as well. (FIG. 26).

Figure 24:
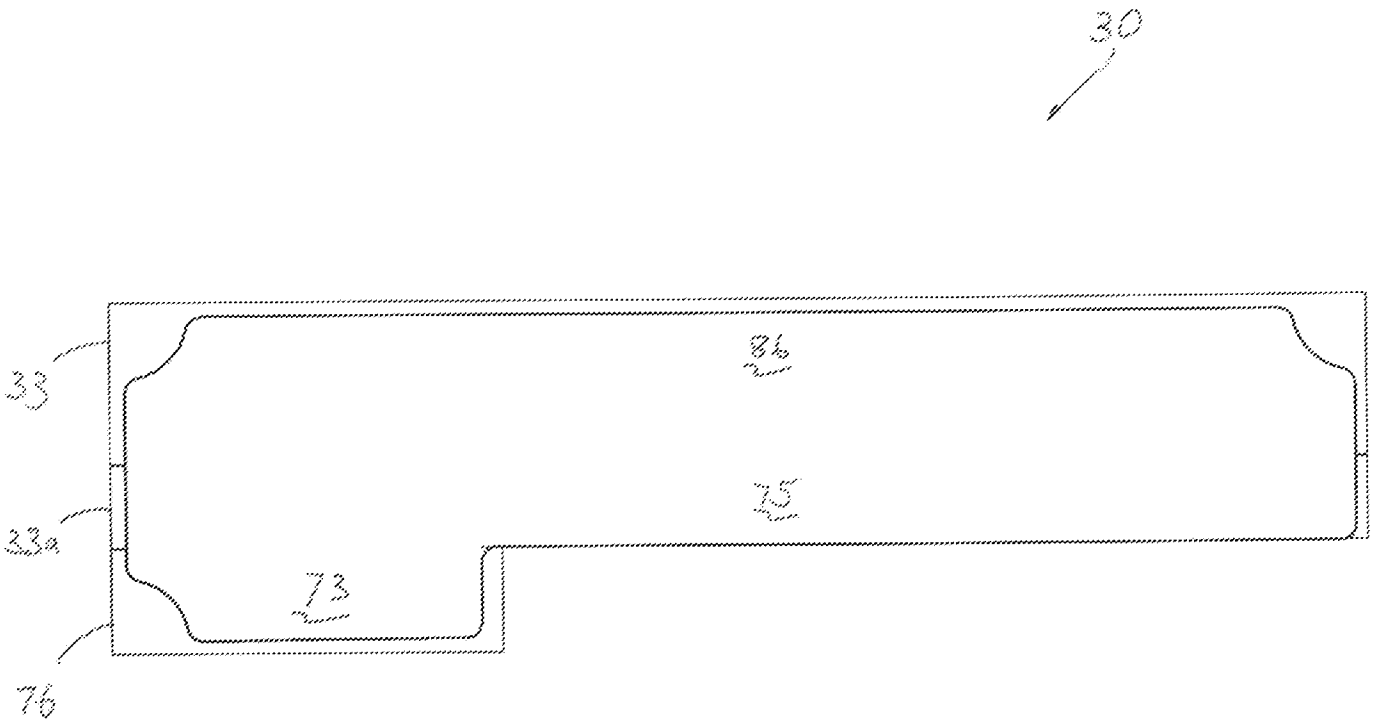
FIG. 24 is a front perspective view of an alternative embodiment tape member of FIG. 22, without the handle cutouts.

In another specific configuration (FIG. 24), only the tape member 30 of which is illustrated, the tape member 30 with the note tab 73 of the present invention is designated for use with a handle-less bag assembly, or one with folded, pop-up style handles that are mounted below the tape member (not shown). In this embodiment, the handle cutouts of the upper lateral portion 86 are removed.

While the present invention has been described in connection with the preferred form of practicing it and modifications thereto, those of ordinary skill in the art will understand that many other modifications can be made thereto within the scope of the claims that follow. Accordingly, it is not intended that the scope of the invention in any way be limited by the above description, but instead be determined entirely by reference to the claims that follow.

What is claimed is:

1. A tamper evident delivery bag assembly configured to mount a note thereon, said bag assembly comprising:

a sheet-like first panel, an opposed sheet-like second panel, and a bottom gusset, each the first and second panel having an interior surface that faces the opposing panel and an exterior surface, each panel further including a respective upper section terminating at an upper first edge of said first panel and an opposed upper second edge of said second panel, said first and second edges cooperating to at least partially define a bag opening into a content receiving region extending between the bag opening, panels and the bottom gusset, said upper sections being movable between an opened condition and a closed condition, orienting said first and second edges generally in opposed, adjacent, relationship to one another;

an elongated, single use closure tape member laterally mounted to the first panel upper section at a middle lateral portion thereof, and having an upper lateral portion extending laterally above said first edge thereof in an unsealed condition, said tape member further including a closure adhesive disposed on an interior surface of the tape upper lateral portion facing said second panel when in the unsealed condition;

a removable protective strip that covers the closure adhesive, wherein, when the protective strip is removed, and said panel upper sections are aligned in said closed condition, said tape upper lateral portion can be folded over the second edge of said second panel such that said adhesive is brought into contact with the exterior surface of said second panel, substantially sealing said bag opening in a sealed condition;

said closure tape member further includes a note tab extending downwardly below only a part of said middle lateral portion, said note tab including a tab adhesive disposed on an interior surface thereof facing the exterior surface of said first panel;

a removable protective cover that covers the tab adhesive, in an unmounted condition, preventing adherence of the note tab to the exterior surface of said first panel, wherein, when the protective cover is removed, the note can be placed between the tab adhesive of said note tab and the exterior surface of the first panel, and adhered therebetween in a mounted condition.

2. The tamper evident delivery bag as recited in claim 1, wherein the lateral dimension of said note tab is in the range of about ¼ to about ⅓ the lateral length of said middle lateral portion of the closure tape member.

3. The tamper evident delivery bag as recited in claim 2, wherein said note tab is positioned along at least one of the left side, the middle and the right side of said middle lateral portion of said closure tape member.

4. The tamper evident delivery bag as recited in claim 1, wherein a vertical dimension of said note tab extending downwardly from a lower edge of said middle lateral portion is in the range of about ¼ inch to about 1½ inches.

5. The tamper evident delivery bag as recited in claim 1, wherein said note tab includes a tab cutout configured to facilitate the ease of removal of the protective cover.

6. The tamper evident delivery bag as recited in claim 5, wherein said tab cutout is positioned at a lower corner of the note tab.

7. The tamper evident delivery bag as recited in claim 1, further including:

a first handle mounted to the upper section of the first panel having a pair spaced-apart first leg portions upstanding from said first edge;

a second handle mounted to the upper section of the second panel having a pair spaced-apart second leg portions upstanding from said second edge, said first and second handles together with said first and second leg portions being generally aligned adjacent one another and collectively defining a gripping passage therethrough when said upper sections are oriented in said closed condition;

said tape upper lateral portion having a pair of handle cutouts strategically aligned with the leg portions of said first handle such that when said tape upper lateral portion is folded over the second edge of said second panel in the sealed condition, said leg portions of the first and second handles are received through the respective handle cutouts of the tape member.

8. The tamper evident delivery bag as recited in claim 7, wherein said tape upper lateral portion defining a middle closure section having a closure height extending vertically from said first edge to an upper edge of said middle closure section, said closure height being less than a vertical height of said gripping passage such that when said tape upper lateral portion is folded over the second edge of said second panel to the sealed condition, said middle closure section passes unobstructedly under the aligned handle members and through the gripping passage.

9. The tamper evident delivery bag as recited in claim 8, wherein said tape upper lateral portion defining a first outer closure section and a second outer closure section on opposed sides of said middle closure section, at least one of the first outer closure section and said second outer closure section having a closure cutout configured to facilitate the ease of removal of the protective strip.

10. The tamper evident delivery bag as recited in claim 1, wherein each said first panel and said second panel having respective first side edges cooperatively joined for securing therewith on one side of the bag assembly, and respective second side edges cooperatively joined for securing therewith on an opposite side of the bag assembly.

11. The tamper evident delivery bag as recited in claim 1 wherein said tape member includes a plurality of elongated scoring slits extending in a direction substantially transverse to the respective first and second edge of the respective first and second panel and across said bag opening when said upper sections are in said closed condition and said tape member is in said sealed.

12. A tamper evident method for delivering one or more food containers in a bag assembly configured to mount a note thereon comprising:

providing a handled delivery bag assembly having a sheet-like first panel, and an opposed sheet-like second panel, each the first and second panel having an interior surface that faces the opposing panel and an exterior surface, each panel further including a respective upper section terminating at an upper first edge of said first panel and an opposed upper second edge of said second panel, said first and second edges cooperating to at least partially define a bag opening into a content receiving region extending between the bag opening and the first and second panels, said upper sections being movable between an opened condition and a closed condition, the bag assembly further includes a single use closure tape member laterally mounted to the first panel upper section at a middle lateral portion thereof, and having an upper lateral portion extending laterally above said first edge thereof in an unsealed condition, said closure tape member further including a note tab extending downwardly from the middle lateral portion in an unmounted condition;

reorienting said upper sections of the bag assembly to the opened condition to enable receipt of the one or more food containers in the content receiving region;

repositioning said upper sections of the bag assembly from the opened condition to the closed condition, orienting said first and second edges generally in opposed, adjacent, relationship to one another;

exposing a closure adhesive disposed on an interior surface of the tape upper lateral portion facing said second panel when in the unsealed condition;

folding said tape upper lateral portion over the second edge of said second panel such that said adhesive is brought into contact with the exterior surface of said second panel, substantially sealing said bag opening in a sealed condition;

exposing a tab adhesive disposed on an interior surface of the note tab facing the exterior surface of said first panel;

placing the note between the exposed tab adhesive of said note tab and the exterior surface of the first panel; and adhering the note therebetween in a mounted condition.

13. The tamper evident method according to claim 12, wherein said exposing the closure adhesive includes removing a protective strip from said closure adhesive; and said exposing the tab adhesive includes removing a protective cover from said tab adhesive.

14. The tamper evident method according to claim 12, wherein said bag assembly further including a first handle mounted to the upper section of the first panel having a pair spaced-apart first leg portions upstanding from said first edge, and a second handle mounted to the upper section second panel having a pair spaced-apart second leg portions upstanding from said second edge, said first and second handles together with the first and second leg portions being generally aligned adjacent one another and collectively defining a gripping passage therethrough when said upper sections are oriented in said closed condition;

said tape upper lateral portion having a pair of handle cutouts strategically aligned with the leg portions of said first handle, wherein, said folding said tape upper lateral portion includes receiving said leg portions of the first and second handles through the respective handle cutouts of the tape member.

15. The tamper evident method according to claim 14, wherein said tape upper portion defining a middle closure section having a closure height extending vertically from said first edge to an upper edge of said middle closure section, said closure height being less than a vertical height of said gripping passage, wherein, said folding said tape upper lateral portion includes passing said middle closure section unobstructedly under the aligned handle members and through the gripping passage toward the sealed condition.

16. A tamper evident paper delivery bag comprising:

a sheet-like first panel, a sheet-like second panel that opposes the first panel, and a bottom gusset, each of the first and second panels having an interior surface that faces the opposing panel and an exterior surface that faces away from the opposing panel, each panel further including a top edge, the top edges of the first and second panels cooperating to at least partially define a bag opening into a content receiving region;

an elongated sealing tape including a mounting portion, a closure portion, a note tab and an inner surface that includes inner surfaces of the mounting portion, the closure portion section and the note tab, wherein (i) the inner surface of the mounting portion of the closure tape is adhesively attached to the exterior surface of the first panel, (ii) the closure portion of the sealing tape extends beyond the top edge of the first panel, and (iii) the note tab extends downwardly below at least a part of the mounting portion;

a closure adhesive disposed on at least some of the inner surface of the closure portion of the sealing tape, the closure adhesive being a single use adhesive;

a tab adhesive disposed on at least some of the note tab;

a removable first protective strip that covers the closure adhesive;

a removable second protective strip that covers the tab adhesive;

wherein the sealing tape is positioned on the first panel such that when the first protective strip is removed and the top edges of the first and second panels are aligned in a closed state, the closure portion of the sealing tape can be folded over the top edge of the second panel to bring the closure adhesive into contact with an upper portion of the second panel to thereby seal the paper delivery bag in a tamper evident manner; and wherein, when the second protective strip is removed, a note can be adhered to the note tab.

17. A tamper evident paper delivery bag as recited in claim 16 wherein the tab adhesive is disposed on the inner surface of the tab note such that when the note is adhered to the note tab, an adhered portion of the note is positioned between the tab note and the first panel.

18. A tamper evident paper delivery bag as recited in claim 16 wherein the sealing tape extends at least about 90 percent of a width of the first panel.

19. A tamper evident paper delivery bag as recited in claim 16 further comprising:

a pair of handles, each handle being attached to or integrally formed with an associated one of the first and second panels and extending above the top edge of the associated panel, and wherein the closure portion of the sealing tape includes a pair of cutouts positioned such that the handles do not interfere with the closure tape when the closure portion of the sealing tape is folded over the top edge of the second panel.

20. A tamper evident paper delivery bag as recited in claim 16 wherein at least one upper corner of the sealing tape and at least one corner of the note tab have concave recesses that provide enlarged access to the first and second protective strips respectively.

21. A tamper evident delivery bag assembly configured to mount a note thereon, said bag assembly comprising:

a sheet-like first panel, an opposed sheet-like second panel, and a bottom gusset, each the first and second panel having an interior surface that faces the opposing panel and an exterior surface, each panel further including a respective upper section terminating at an upper first edge of said first panel and an opposed upper second edge of said second panel, said first and second edges cooperating to at least partially define a bag opening into a content receiving region extending between the bag opening, panels and the bottom gusset, said upper sections being movable between an opened condition and a closed condition, orienting said first and second edges generally in opposed, adjacent, relationship to one another;

an elongated, single use closure tape member laterally mounted to the first panel upper section at a middle lateral portion thereof, and having an upper lateral portion extending laterally above said first edge thereof in an unsealed condition, said tape member further including a closure adhesive disposed on an interior surface of the tape upper lateral portion facing said second panel when in the unsealed condition;

a removable protective strip that covers the closure adhesive, wherein, when the protective strip is removed, and said panel upper sections are aligned in said closed condition, said tape upper lateral portion can be folded over the second edge of said second panel such that said adhesive is brought into contact with the exterior surface of said second panel, substantially sealing said bag opening in a sealed condition;

said closure tape member further includes a note tab extending downwardly from said middle lateral portion, said note tab including a tab adhesive disposed on an interior surface thereof facing the exterior surface of said first panel;

a removable protective cover that covers the tab adhesive, in an unmounted condition, preventing adherence of the note tab to the exterior surface of said first panel, and said note tab including a tab cutout configured to facilitate the ease of removal of the protective cover, wherein, when the protective cover is removed, the note can be placed between the tab adhesive of said note tab and the exterior surface of the first panel, and adhered therebetween in a mounted condition.

22. The tamper evident delivery bag as recited in claim 21, wherein said tab cutout is positioned at a lower corner of the note tab.

* * * * *